US007668712B2

(12) United States Patent
Wang et al.

(10) Patent No.: US 7,668,712 B2
(45) Date of Patent: Feb. 23, 2010

(54) AUDIO ENCODING AND DECODING WITH INTRA FRAMES AND ADAPTIVE FORWARD ERROR CORRECTION

(75) Inventors: Tian Wang, Redmond, WA (US); Hosam A. Khalil, Redmond, WA (US); Kazuhito Koishida, Redmond, WA (US); Wei-Ge Chen, Issaquah, WA (US); Mu Han, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 854 days.

(21) Appl. No.: 10/816,466

(22) Filed: Mar. 31, 2004

(65) Prior Publication Data

US 2005/0228651 A1 Oct. 13, 2005

(51) Int. Cl.
*G10L 19/00* (2006.01)

(52) U.S. Cl. ..... 704/219

(58) Field of Classification Search ..... 704/200, 704/201, 219–213
See application file for complete search history.

(56) References Cited

U.S. PATENT DOCUMENTS 4,815,134 A 3/1989 Picone et al.
4,969,192 A 11/1990 Chen et al.
5,255,339 A 10/1993 Fette et al.
5,394,473 A 2/1995 Davidson
5,615,298 A 3/1997 Chen
5,664,051 A 9/1997 Hardwick et al.
5,664,055 A * 9/1997 Kroon ..... 704/223
5,668,925 A 9/1997 Rothweiler et al.
5,699,477 A 12/1997 McCree
5,699,485 A * 12/1997 Shoham ..... 704/223
5,717,823 A 2/1998 Kleijn
5,724,433 A 3/1998 Engebretson et al.
5,734,789 A 3/1998 Swaminathan et al.
5,737,484 A 4/1998 Ozawa (Continued)

FOREIGN PATENT DOCUMENTS

CA 1336454 7/1995

(Continued)

OTHER PUBLICATIONS

ITU-T, "ITU-T Recommendation G.729, Coding of Speech at 8 kbit/s Using Conjugate-Structure Algebraic-Code-Excited Linear-Prediction (CS-ACELP)," 35 pp. (1996).

(Continued)

*Primary Examiner*—Michael N Opsasnick
(74) *Attorney, Agent, or Firm*—Klarquist Sparkman, LLP

(57) ABSTRACT

Various strategies for rate/quality control and loss resiliency in an audio codec are described. The various strategies can be used in combination or independently. For example, a real-time speech codec uses intra frame coding/decoding, adaptive multi-mode forward error correction ["FEC"], and rate/quality control techniques. Intra frames help a decoder recover quickly from packet losses, while compression efficiency is still emphasized with predicted frames. Various strategies for inserting intra frames and signaling intra/predicted frames are described. With the adaptive multi-mode FEC, an encoder adaptively selects between multiple modes to efficiently and quickly provide a level of FEC that takes into account the bandwidth currently available for FEC. The FEC information itself may be predictively encoded and decoded relative to primary encoded information. Various rate/quality and FEC control strategies allow additional adaptation to available bandwidth and network conditions.

18 Claims, 8 Drawing Sheets

U.S. PATENT DOCUMENTS

| | | | | |
|---|---|---|---|---|
| 5,751,903 | A | 5/1998 | Swaminathan et al. | |
| 5,778,335 | A | 7/1998 | Ubale et al. | |
| 5,819,212 | A | 10/1998 | Matsumoto et al. | |
| 5,819,298 | A | 10/1998 | Wong et al. | |
| 5,835,495 | A | 11/1998 | Ferriere | |
| 5,845,244 | A * | 12/1998 | Proust | 704/200.1 |
| 5,870,412 | A | 2/1999 | Schuster et al. | |
| 5,873,060 | A | 2/1999 | Ozawa | |
| 5,890,108 | A | 3/1999 | Yeldener | |
| 6,009,122 | A | 12/1999 | Chow | |
| 6,029,126 | A | 2/2000 | Malvar | |
| 6,041,345 | A | 3/2000 | Levi et al. | |
| 6,064,962 | A | 5/2000 | Oshikiri et al. | |
| 6,108,626 | A | 8/2000 | Cellario et al. | |
| 6,122,607 | A * | 9/2000 | Ekudden et al. | 704/212 |
| 6,128,349 | A | 10/2000 | Chow | |
| 6,134,518 | A | 10/2000 | Cohen et al. | |
| 6,199,037 | B1 | 3/2001 | Hardwick | |
| 6,202,045 | B1 | 3/2001 | Ojala et al. | |
| 6,226,606 | B1 | 5/2001 | Acero | |
| 6,240,387 | B1 | 5/2001 | DeJaco | |
| 6,263,312 | B1 | 7/2001 | Kolesnik et al. | |
| 6,289,297 | B1 | 9/2001 | Bahl | |
| 6,292,834 | B1 | 9/2001 | Ravi et al. | |
| 6,310,915 | B1 | 10/2001 | Wells et al. | |
| 6,311,154 | B1 | 10/2001 | Gersho et al. | |
| 6,317,714 | B1 | 11/2001 | Del Castillo et al. | |
| 6,330,533 | B2 * | 12/2001 | Su et al. | 704/220 |
| 6,351,730 | B2 | 2/2002 | Chen | |
| 6,385,573 | B1 | 5/2002 | Gao et al. | |
| 6,392,705 | B1 | 5/2002 | Chaddha | |
| 6,408,033 | B1 | 6/2002 | Chow et al. | |
| 6,438,136 | B1 | 8/2002 | Bahl | |
| 6,460,153 | B1 | 10/2002 | Chou et al. | |
| 6,493,665 | B1 | 12/2002 | Su et al. | |
| 6,499,060 | B1 | 12/2002 | Wang et al. | |
| 6,505,152 | B1 | 1/2003 | Acero | |
| 6,564,183 | B1 | 5/2003 | Hagen et al. | |
| 6,614,370 | B2 | 9/2003 | Gottesman | |
| 6,621,935 | B1 | 9/2003 | Xin et al. | |
| 6,647,063 | B1 | 11/2003 | Oikawa | |
| 6,647,366 | B2 | 11/2003 | Wang et al. | |
| 6,658,383 | B2 | 12/2003 | Koishida et al. | |
| 6,693,964 | B1 | 2/2004 | Zhang et al. | |
| 6,732,070 | B1 | 5/2004 | Rotola-Pukkila et al. | |
| 6,757,654 | B1 | 6/2004 | Westerlund et al. | |
| 6,772,126 | B1 | 8/2004 | Simpson et al. | |
| 6,775,649 | B1 | 8/2004 | DeMartin | |
| 6,823,303 | B1 | 11/2004 | Su et al. | |
| 6,934,678 | B1 | 8/2005 | Yang | |
| 6,952,668 | B1 | 10/2005 | Kapilow | |
| 6,968,309 | B1 | 11/2005 | Makinen et al. | |
| 7,002,913 | B2 | 2/2006 | Huang et al. | |
| 7,003,448 | B1 | 2/2006 | Lauber et al. | |
| 7,065,338 | B2 | 6/2006 | Mano et al. | |
| 7,117,156 | B1 | 10/2006 | Kapilow | |
| 7,246,037 | B2 | 7/2007 | Evans | |
| 7,356,748 | B2 | 4/2008 | Taleb | |
| 2001/0023395 | A1 | 9/2001 | Su et al. | |
| 2002/0072901 | A1 | 6/2002 | Bruhn | |
| 2002/0097807 | A1 | 7/2002 | Gerrits | |
| 2002/0159472 | A1 | 10/2002 | Bialik | |
| 2003/0004718 | A1 | 1/2003 | Rao | |
| 2003/0009326 | A1 | 1/2003 | Wang et al. | |
| 2003/0016630 | A1 | 1/2003 | Vega-Garcia et al. | |
| 2003/0072464 | A1 | 4/2003 | Kates | |
| 2003/0101050 | A1 | 5/2003 | Khalil et al. | |
| 2003/0115050 | A1 | 6/2003 | Chen et al. | |
| 2003/0115051 | A1 | 6/2003 | Chen et al. | |
| 2003/0135631 | A1 | 7/2003 | Li et al. | |
| 2005/0075869 | A1 | 4/2005 | Gersho et al. | |
| 2005/0165603 | A1 | 7/2005 | Bessette et al. | |
| 2005/0267753 | A1 | 12/2005 | Yang | |
| 2005/0281345 | A1 | 12/2005 | Obernosterer et al. | |
| 2006/0271354 | A1 | 11/2006 | Sun et al. | |
| 2006/0271355 | A1 | 11/2006 | Wang et al. | |
| 2006/0271373 | A1 | 11/2006 | Khalil et al. | |
| 2007/0088558 | A1 | 4/2007 | Vos et al. | |
| 2007/0255558 | A1 | 11/2007 | Yasunaga et al. | |
| 2007/0255559 | A1 | 11/2007 | Gao et al. | |
| 2008/0232612 | A1 | 9/2008 | Tourwe | |

FOREIGN PATENT DOCUMENTS

| | | |
|---|---|---|
| EP | 0 503 684 | 9/1992 |
| FR | 2 784 218 | 4/2000 |
| GB | 2 324 689 | 10/1998 |
| JP | 1013200 | 1/1989 |
| WO | WO 98 27543 | 6/1998 |
| WO | WO 00 11655 | 3/2000 |
| WO | WO 03 102921 | 12/2003 |

OTHER PUBLICATIONS

Andersen et al., "ILBC—a Linear Predictive Coder with Robustness to Packet Losses," Proc. IEEE Workshop on Speech Coding, 2002, pp. 23-25 (2002).

Erdmann et al., "An Adaptive Multi Rate Wideband Speech Codec with Adaptive Gain Re-quantization," Proc. IEEE Workshop on Speech Coding, 2000, pp. 145-147 (2000).

Erhart et al., "A speech packet recovery technique using a model based tree search interpolator," Proc. 1993 IEEE Workshop on Speech Coding for Telecommunications, pp. 77-78 (1993).

Feldbauer et al., "Speech Coding Using Motion Picture Compression Techniques," Proc. IEEE Workshop on Speech Coding, 2002, pp. 47-49 (2002).

Fingscheidt et al., "Joint Speech Codec Parameter and Channel Decoding of Parameter Individual Block Codes (PIBC)," Proc. 1999 IEEE Workshop on Speech Coding, pp. 75-77 (1999).

Fout, "Media Support in the Microsoft Windows Real-Time Communications Client," 6 pp. [Downloaded from the World Wide Web on Feb. 26, 2004.].

Heinen et al., "Robust Speech Transmission Over Noisy Channels Employing Non-linear Block Codes," Proc. 1999 IEEE Workshop on Speech Coding, pp. 72-74 (1999).

Ikeda et al., "Error-Protected TwinVQ Audio Coding at Less Than 64 kbit/s/ch," Proc. 1995 IEEE Workshop on Speech Coding for Telecommunications, pp. 33-34 (1995).

Johansson et al., "Bandwidth Efficient AMR Operation for VoIP," Proc. IEEE Workshop on Speech Coding, 2002, pp. 150-152.

Koishida et al., "Enhancing MPEG-4 CELP by Jointly Optimized Inter/Intra-frame LSP Predictors," Proc. IEEE Workshop on Speech Coding, 2000, pp. 90-92.

Kubin et al., "Multiple-Description Coding (MDC) of Speech with an Invertible Auditory Model," Proc. 1999 IEEE Workshop on Speech Coding, pp. 81-83 (1999).

Lakaniemi et al., "AMR and AMR-WB RTP Payload Usage in Packet Switched Conversational Multimedia Services," Proc. IEEE Workshop on Speech Coding, 2002, pp. 147-149.

Makinen et al., "The Effect of Source Based Rate Adaptation Extension in AMR-WB Speech Codec," Proc. IEEE Workshop on Speech Coding, 2002, pp. 153-155.

Morinaga et al., "The Forward-Backward Recovery Sub-Codec (FB-RSC) Method: A Robust Form of Packet-Loss Concealment for Use in Broadband IP Networks," Proc. IEEE Workshop on Speech Coding, 2002, pp. 62-64.

Nomura et al., "Voice Over IP Systems with Speech Bitrate Adaptation Based on MPEG-4 Wideband CELP," Proc. 1999 IEEE Workshop on Speech Coding, pp. 132-134 (1999).

Ozawa et al., "Study and Subjective Evaluation on MPEG-4 Narrowband CELP Coding Under Mobile Communication Conditions," Proc. 1999 IEEE Workshop on Speech Coding, pp. 129-131 (1999).

Rahikka et al., "Error Coding Strategies for MELP Vocoder in Wireless and ATM Environments," IEEE Seminar on Speech Coding for Algorithms for Radio Channels, pp. 8/1-8/3 (2000).

Rahikka et al., "Optimized Error Correction of MELP Speech Parameters Via Maximum A Posteriori (MAP) Techniques," Proc. 1999 IEEE Workshop on Speech Coding, pp. 78-80 (1999).
Salami et al., "A robust transformed binary vector excited coder with embedded error-correction coding," IEEE Colloquium on Speech Coding, pp. 5/1-5/6 (1989).
Salami et al., "The Adaptive Multi-Rate Wideband Codec: History and Performance," Proc. IEEE Workshop on Speech Coding, 2002, pp. 144-146.
Swaminathan et al., "A Robust Low Rate Voice Codec for Wireless Communications," Proc. 1997 IEEE Workshop on Speech Coding for Telecommunications, pp. 75-76 (1997).
Taumi et al., "13kbps Low-Delay Error-Robust Speech Coding for GSM EFR," 1995 IEEE Workshop on Speech Coding for Telecommunications, pp. 61-62 (1995).
Microsoft Corporation, "Using the Windows Media Audio 9 Voice Codec," 4 pp. [Downloaded from the World Wide Web on Feb. 26, 2004.].
Wang et al., "A 1200/2400 BPS Coding Suite Based on MELP," Proc. IEEE Workshop on Speech Coding, 2002, pp. 90-92.
Wang et al., "Performance Comparison of Intraframe and Interframe LSF Quantization in Packet Networks," Proc. IEEE Workshop on Speech Coding, 2000, pp. 126-128.
Wang et al., "Wideband Speech Coder Employing T-codes and Reversible Variable Length Codes," Proc. IEEE Workshop on Speech Coding, 2002, pp. 117-119.
International Search Report and Written Opinion for PCT/US06/12641.
European Search Report for PCT/US06/12686 dated Aug. 13, 2008, 8 pages.
B. Bessette, R. Salami, C. Laflamme and R. Lefebvre, "A Wideband Speech and Audio Codec at 16/24/32 kbit/s using Hybrid ACELP/TCX Techniques," in Proc. IEEE Workshop on Speech Coding, pp. 7-9, 1999.
Chen et al., "Adaptive Postfiltering for Quality Enhancement of Coded Speech," IEEE Transactions on Speech and Audio Processing, vol. 3, No. 1, pp. 59-71 (1995).
J-H. Chen and D. Wang, "Transform Predictive Coding of Wideband Speech Signals," in Proc. International Conference on Acoustic, Speech, Signal Processing, pp. 275-278, 1996.
Combescure, P., et al., "A16, 24, 32 kbit/s Wideband Speech Codec Based on ATCELP," *In Proceedings of IEEE International Conference on Acoustics, Speech, and Signal Processing*, vol. 1, pp. 5-8 (Mar. 1999).
El Maleh, K., et al., "Speech/Music Discrimination for Multimedia Applications," *In Proceedings of IEEE International Conference on Acoustics, Speech, and Signal Processing*, vol. 4, pp. 2445-2448, (Jun. 2000).
Ellis, D., et al. "Speech/Music Discrimination Based on Posterior Probability Features," *In Proceedings of Eurospeech*, 4 pages, Budapest (1999).
Gersho, A., "Advances in Speech and Audio Compression", *Proceedings of the IEEE*, vol. 82(6):900-918 (Jun. 1994).
Gersho, A., et al., "Vector Quantization and Signal Compression", Dordrecht, Netherlands,: Kluwer *Academic Publishers*, 1992, xxii+732pp.
Gerson et al., "Vector Sum Excited Linear Prediction (VSELP) Speech Coding at 8 KBPS," CH2847-2/90/0000-0461 IEEE, pp. 461-464 (1990).
Hardwick, J.C.; Lim, J.S., "A 4.8 KBPS Multi-Brand Excitation Speech Coder", *ICASSP 1988 International Conference on Acoustics, Speech, and Signal*, New York, NY, USA, Apr. 11-14, 1988,: *IEEE*, vol. 1, pp. 374-377.
Houtgast, T., et al., "The Modulation Transfer Function in Room Acoustics As A Predictor or Speech Intelligibility," *Acustica*, vol. 23, pp. 66-73 (1973).
ITU-T, G.722.1 (Sep. 1999), Series G: Transmission Systems and Media, Digital Systems and Networks, Coding at 24 and 32 kbit/s for hands-free operation in systems with low frame loss.
ITU-T, "ITU-T Recommendation G.722, General Aspects of Digital Transmission Systems—Terminal Equipments 7 kHz Audio—Coding within 64 kbit/s," 75 pp. (1988).
ITU-T, "ITU-T Recommendation G.722.1, Series G: Transmission Systems and Media, Digital Systems and Networks. Digital terminal equipments—Coding of analogue signals by methods other than PCM—Coding at 24 and 32 kbit/s for hands-free operation in systems with low frame loss," 26 pp. (1999).
ITU-T, "ITU-T Recommendation G.722.1—Corrigendum 1, Series G: Transmission Systems and Media, Digital Systems and Networks. Digital terminal equipments—Coding of analogue signals by methods other than PCM—Coding at 24 and 32 kbit/s for hands-free operation in systems with low frame loss," 9 pp. (2000).
ITU-T, "ITU-T Recommendation G.722.1 Annex A, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex A: Packet format, capability identifiers and capability parameters" 9 pp. (2000).
ITU-T, "ITU-T Recommendation G.722.1 Annex B, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex B: Floating-point implementation for G.722.1" 9 pp. (2000).
ITU-T, "ITU-T Recommendation G.722.2, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 71 pp. (2003).
ITU-T, "ITU-T Recommendation G.722.2 Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 1 p. (2004).
ITU-T, "ITU-T Recommendation G.722.2 Annex A, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex A: Comfort noise aspects," 14 pp. (2002).
ITU-T, "ITU-T Recommendation G.722.2 Annex B, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 13 pp. (2002).
ITU-T, "ITU-T Recommendation G.722.2 Annex B Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 1 p. (2003).
ITU-T, "ITU-T Recommendation G.722.2 Annex C Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex C: Fixed-point C-code," 2 pp. (2004).
ITU-T, "ITU-T Recommendation G.722.2 Annex D, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex D: Digital test sequences," 13 pp. (2003).
ITU-T, "ITU-T Recommendation G.722.2 Annex E, Series G: Transmission Systems and Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 27 pp. (2002).
ITU-T, "ITU-T Recommendation G.722.2 Annex E Corrigendum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 1 p. (2003).

ITU-T, "ITU-T Recommendation G.722.2 Annex F, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex F: AMR-WB using in H.245," 10 pp. (2002).

ITU-T, "ITU-T Recommendation G.723.1, General Aspects of Digital Transmission Systems, Dual Rate Speech Coder for Multimedia Communications Transmitting at 5.3 and 6.3 kbit/s," 31 pp. (1996).

ITU-T, "ITU-T Recommendation G.723.1 Annex A, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex A: Silence compression scheme," 21 pp. (1996).

ITU-T, "ITU-T Recommendation G.723.1 Annex B, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex B: Alternative specification based on floating point arithmetic," 8 pp. (1996).

ITU-T, "ITU-T Recommendation G.723.1 Annex C, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex C: Scalable channel coding scheme for wireless applications," 23 pp. (1996).

ITU-T, "ITU-T Recommendation G.728, General Aspects of Digital Transmission Systems; Terminal Equipment Coding of Speech at 16kbit/s Using Low-Delay Code Excited Linear Prediction," 65 pp. (1992).

ITU-T, "ITU-T Recommendation G.728 Annex G, General Aspects of Digital Transmission Systems; Terminal Equipment Coding of Speech at 16 kbit/s Using Low-Delay Code Excited Linear Prediction, Annex G: 16 kbit/s Fixed Point Specification," 67 pp. (1994).

ITU-T, "ITU-T Recommendation G.728 Annex G Corrigendum 1, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex G: 26 kbit/s Fixed Point Specification—Corrigendum 1," 11 pp. (2000).

ITU-T, "ITU-T Recommendation G.728 Annex H, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex H: Variable bit rate LD-CELP operation mainly for DCME at rates less than 16 kbit/s," 19 pp. (1999).

ITU-T, "ITU-T Recommendation G.728 Annex I, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex I: Frame or packet loss concealment for the LD-CELP decoder," 25 pp. (1999).

ITU-T, "ITU-T Recommendation G.728 Annex J, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex J: Variable bit-rate operation of LD-CELP mainly for voiceband-data applications in DCME," 40 pp. (1999).

ITU-T, "ITU-T Recommendation G.729, Coding of Speech at 8 kbit/s Using Conjugate-Structure Algebraic-Code-Excited Linear-Prediction (CS-ACELP)," 39 pp. (1996).

Kabal et al., "Adaptive Postfiltering for Enhancement of Noisy Speech in the Frequency Domain," CH 3006-4/91/0000-0312 IEEE, pp. 312-315; Jun. 1991.

Kemp, D.P.; Collura J.S., ; Tremain, T.E., Multi-Frame Coding of LPC Acoustics, Speech, and Signal Processing, Toronto, Ont., Canada, May 14-17, 1991; New York, N.Y. USA, *IEEE*, 1991, vol. 1, pp. 609-612.

Kroon et al., "Quantization Procedures for the Excitation of Celp Coders," CH2396-0/87/0000-1649 IEEE, pp. 1649-1652 (1987).

Leblanc, W.P., et al., "Efficient Search and Design Procedures for Robust Multi-Stage VQ of LPC Parameters for 4KB/S Speech Coding". In *IEEE Trans. Speech & Audio Processing*, vol. 1, pp. 272-285, (Oct. 1993).

Lefebvre, et al., "High quality coding of wideband audio signals using transform coded excitation (TCS)," Apr. 1994, 1994 IEEE International Conference on Acoustics, Speech, and Signal Processing, vol. 1, pp. I/193-I/196.

Lefebvre et al., "Spectral Amplitude Warping (SAW) for Noise Spectrum Shaping in Audio Coding," IEEE, pp. 335-338 (1997).

Liang, et al., "Adaptive Playout Scheduling and Loss Concealment for Voice Communication Over IP Networks," IEEE Transactions on Multimedia, vol. 5, No. 4, pp. 532-543 (2003).

McAulay, "Sine-Wave Amplitude Coding at Low Data Rates, Advances in Speech Coding," *Kluwer Academic Pub.*, pp. 203-214, 1991.

McCree, et al., "A 2.4 kbit/s MELP Coder Candidate for the New U.S. Federal Standard", *1996 IEEE International Conference on Acoustics, Speech, and Signal Processing Conference Proceedings*, Atlanta, GA (Cat. No. 96CH35903), vol. 1, pp. 200-203, May 7-10, 1996.

McCree, A.V., et al., "A Mixed Excitation LPC Vocoder Model for Low Bit Rate Speech Coding", *IEEE Transaction on Speech and Audio Processing*, vol. 3(4):242-250 (Jul. 1995).

Mouy, B. et al., "Nato Stanag 4479: A Standard for An 800 BPS Vocoder and Channel Coding In HF-ECCM System", 1995 International Conference on Acoustics, Speech, and Signal Processing Conference Proceedings, Detroit MI, USA, May 9-12, 1999; New York, NY, USA: *IEEE*, 1995, vol. 1, pp. 480-483.

Mouy, B.M.; De La Noure, P.E., "Voice Transmission at a Very Low Bit Rate on A Noisy Channel: 800 BPS Vocoder with Error Protection to 1200 BPS", *ICASSP-92: 1992 IEEE International Conference on Acoustics, Speech, and Signal*, San Francisco, CA, USA, Mar. 23-26, 1992, New York, NY, USA: *IEEE*, 1992 vol. 2, pp. 149-152.

Mustapha et al., "An Adaptive Post-Filtering Technique Based on the Modified Yule-Walker Filter," ICASSP-1999, 4 pp. (1999).

Nishiguchi, L.; Iijima, K.; Matsumoto, J., "Harmonic Vector Excitation Coding of Speech at 2.0 KPS", *1997 IEEE Workshop on Speech coding for telecommunication proceedings*, Pocono Manor, PA, USA, Sep. 7-10, 1997, New York, NY, USA,: *IEEE*, 1997, pp. 39-40.

Nomura, T.; Iwadare, M.; Serizawa, M.; Ozawa, K., "a Bitrate and Bandwidth Scalable Celp Coder", *ICASSP 1998 International Conference on Acoustics, Speech, and Signal*, Seattle, WA, USA, May 12-15, 1998, *IEEE*, 1998, vol. 1, pp. 341-344.

Ramjee et al., "Adaptive Playout Mechanisms for Packetized Audio Applications in Wide-Area Networks," 0743-166X/94 IEEE, pp. 680-688 (1994).

S.A. Ramprashad, "A Multimode Transform Predictive Coder (MTPC) for Speech and Audio," in Proc. IEEE Workshop on Speech Coding, pp. 10-12, 1999.

Salami, et al., "A wideband codec at 16/24 kbit/s with 10 ms frames," Sep. 1997, 1997 Workshop on Speech Coding for Telecommunications, pp. 103-104.

Saunders, J., "Real Time Discrimination of Broadcoast Speech/Music," *Proceedings of IEEE International Conference on Acoustics, Speech, and Signal Processing*, vol. 2, pp. 993-996 (May 1996).

Scheirer, E., et al., "Construction and Evaluation of a Robust Multifeature Speech/Music Discriminator," *In Proceedings of IEEE International Conference on Acoustics, Speech, and Signal Processing*, vol. 2, pp. 1331-1334, (Apr. 1997).

J. Schnitzler, J. Eggers, C. Erdmann and P. Vary, "Wideband Speech Coding Using Forward/Backward Adaptive Prediction with Mixed Time/Frequency Domain Excitation," in Proc. IEEE Workshop on Speech Coding, pp. 3-5, 1999.

Schroeder et al., "Code-Excited Linear Prediction (CELP): High-Quality Speech at Very Low Bit Rates," CH2118-8/85/0000-0937 IEEE, pp. 937-940 (1985).

Sreenan et al., "Delay Reduction Techniques for Playout Buffering," IEEE Transactions on Multimedia, vol. 2, No. 2, pp. 88-100 (2000).

Supplee, Lyn M. et al., "MELP: The New Federal Standard at 2400 BPS", *IEEE 1997*, pp. 1591-1594 in lieu of the following which we are unable to obtain *Specification for the Analog to Digital Conversation of Voice by 2,400 Bit/Second Mixed Excitation Linear Prediction FIPS, Draft document of proposed Federal Standard*, dated May 28, 1998.

L. Tancerel, R. Vesa, V.T. Ruoppila and R. Lefebvre, "Combined Speech and Audio Coding by Discrimination," in Proc. IEEE Workshop on Speech Coding, pp. 154-156, 2000.

Tasaki et al., "Post Noise Smoother to Improve Low Bit Rate Speech-Coding Performance," 0-7803-5651-9/99 IEEE, pp. 159-161 (1999).

Tasaki et al., "Spectral Postfilter Design Based on LSP Transformation," 0-7803-4073-6/97 IEEE, pp. 57-58 (1997).

Tzanetakis, G., et al., "Multifeature Audio Segmentation for Browsing and Annotation," *Proc. IEEE Workshop on Applications of Signal Processing to Audio and Acoustics*, New Paltz, NY, pp. 103-106 (Oct. 1999).

A. Ubale and A. Gersho, "Multi-Band CELP Wideband Speech Coder," Proc. IEEE Int. Conf. on Acoustics, Speech and Signal Processing, Munich, pp. 1367-1370; Apr. 1997.

Wang, Tian et al., "A 1200 BPS Speech Coder Based on MELP", *in Proceedings of the IEEE International Conference on Acoustics, Speech and Signal Processing*, Jun. 2000, pp. 1375-1378.

* cited by examiner

AUDIO ENCODING AND DECODING WITH INTRA FRAMES AND ADAPTIVE FORWARD ERROR CORRECTION

TECHNICAL FIELD

Rate/quality control and loss resiliency techniques for an audio codec are described. For example, a real-time speech codec uses intra-frame coding/decoding, rate/quality control, and adaptive forward error correction to adapt seamlessly to changing network conditions.

BACKGROUND

With the emergence of digital wireless telephone networks, streaming audio over the Internet, and Internet telephony, digital processing and delivery of speech has become commonplace. Engineers use a variety of techniques to process speech efficiently while still maintaining quality. To understand these techniques, it helps to understand how audio information is represented and processed in a computer.

I. Representation of Audio Information in a Computer

A computer processes audio information as a series of numbers representing the audio. A single number can represent an audio sample, which is an amplitude value (i.e., loudness) at a particular time. Several factors affect the quality of the audio, including sample depth and sampling rate.

Sample depth (or precision) indicates the range of numbers used to represent a sample. The more values possible for the sample, the higher the quality because the number can capture more subtle variations in amplitude. An 8-bit sample has 256 possible values, while a 16-bit sample has 65,536 possible values. A 24-bit sample can capture normal loudness variations very finely, and can also capture unusually high loudness.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second. Table 1 shows several formats of audio with different quality levels, along with corresponding raw bitrate costs.

TABLE 1

Bitrates for different quality audio

| Sample Depth (bits/sample) | Sampling Rate (samples/second) | Channel mode | Raw Bitrate (bits/second) |
|---|---|---|---|
| 8 | 8,000 | mono | 64,000 |
| 8 | 11,025 | mono | 88,200 |
| 16 | 44,100 | stereo | 1,411,200 |

As Table 1 shows, the cost of high quality audio is high bitrate. High quality audio information consumes large amounts of computer storage and transmission capacity. Many computers and computer networks lack the resources to process raw digital audio. Compression (also called encoding or coding) decreases the cost of storing and transmitting audio information by converting the information into a lower bitrate form. Compression can be lossless (in which quality does not suffer) or lossy (in which quality suffers but bitrate reduction from subsequent lossless compression is more dramatic). Decompression (also called decoding) extracts a reconstructed version of the original information from the compressed form. A codec is an encoder/decoder system.

II. Speech Encoders and Decoders

The primary goal of audio compression is to digitally represent audio signals to provide maximum signal quality with the least possible amount of bits. Different kinds of audio signals have different characteristics. Music is characterized by large ranges of frequencies and amplitudes, and often includes 2 or more channels. On the other hand, speech is characterized by smaller ranges of frequencies and amplitudes, and is commonly represented in a single channel. Certain codecs and processing techniques are adapted for music and general audio; other codecs and processing techniques are adapted for speech.

A conventional speech codec uses linear prediction to achieve compression. The speech encoding includes several stages. The encoder finds and quantizes coefficients for a linear prediction filter, which is used to predict sample values as linear combinations of preceding sample values. A residual signal (represented as an "excitation" signal) indicates parts of the original signal not accurately predicted by the filtering. At some stages, the speech codec uses different compression techniques for voiced segments (characterized by vocal chord vibration), unvoiced segments, and silent segments, since different kinds of speech have different characteristics. Voiced segments typically exhibit highly repeating voicing patterns, even in the residual domain. For voiced segments, the encoder achieves further compression by comparing the current residual signal to previous residual cycles and encoding the current residual signal in terms of delay or lag information relative to the previous cycles. The encoder handles other discrepancies between the original signal and the predicted, encoded representation using specially designed codebooks.

International Telecommunications Union ["ITU"] Recommendation G.729 is a standard for coding speech at 8 kilobits per second using conjugate structure algebraic-code-excited linear prediction ["CS-ACELP"]. The codec operates on speech frames of 10 ms, which correspond to 80 samples at a sampling rate of 8000 samples per second. For every 10 ms frame, the encoder analyzes the speech signal to extract the parameters of the CELP model. The parameters include linear prediction filter coefficients per frame and various excitation parameters per 5 ms sub-frame of the frame. The excitation parameters represent the excitation signal, which is used in the encoder and decoder as input to the LPC synthesis filter. The excitation parameters include pitch (to represent the excitation signal with reference to previous excitation cycles), remainder indices (to represent remaining parts of the excitation signal), and gains (to scale the contributions from the pitch and/or remainder indices). The parameters are encoded and transmitted.

At the decoder, the excitation parameters are decoded and used to reconstruct the excitation signal. The linear prediction filter coefficients are decoded and used in the synthesis filter, which is sometimes called the "short-term prediction" filter. The excitation signal is fed to the synthesis filter, which predicts samples as linear combinations of previously reconstructed samples and adjusts the synthesis filter output (linear predicted values) by adding values from the excitation signal. For more details, see ITU-T Recommendation G.729.

Aside from G.729, various other standards have specified speech encoders and/or decoders, and various companies and researchers have produced speech encoders and/or decoders. For example, whereas G.729 describes a fixed bitrate encoder (8 Kb/s), the Adaptive Multirate ["AMR"] codec operates adaptively at various different bitrates. For more details about the AMR codec, see the articles by (1) Salami et al., entitled "The Adaptive Multi-Rate Wideband Codec: History and Performance," Proc. IEEE Workshop on Speech Coding, 2002, pp. 144-146 (2002); (2) Lakaniemi et al., entitled "AMR and AMR-WB RTP Payload Usage in Packet Switched Conversational Multimedia Services," Proc. IEEE Workshop on Speech Coding, 2002, pp. 147-149 (2002); (3) Johansson et al., entitled "Bandwidth Efficient AMR Operation for VoIP," Proc. IEEE Workshop on Speech Coding, 2002, pp. 150-152 (2002); and (4) Makinen et al., entitled "The Effect of Source Based Rate Adaptation Extension in AMR-WB Speech Codec," Proc. IEEE Workshop on Speech Coding, 2002, pp. 153-155 (2002).

Many speech codecs exploit temporal redundancy in a signal in some way. One common way uses long-term prediction of pitch parameters to predict a current excitation signal in terms of delay or lag relative to previous excitation cycles. Delay values in the range of 30-120 samples or even more samples are common. Exploiting temporal redundancy can greatly improve compression efficiency, but at the cost of introducing memory dependency into the codec—a decoder relies on one part of the signal to correctly decode another part of the signal. In general, the most efficient speech codecs have significant memory dependence.

Although speech codecs as described above have good overall performance for many applications, they have several drawbacks. In particular, several drawbacks surface when the speech codecs are used in conjunction with dynamic network resources. In such scenarios, encoded speech may be lost because of a temporary bandwidth shortage or condition problem.

A. Inefficient Memory Dependence in Dynamic Network Conditions

When encoded speech is lost, performance of speech codecs can suffer due to memory dependence upon the lost information. Loss of information for an excitation signal hampers later reconstruction that depends on the excitation signal. If previous cycles are lost, lag information is not useful, as it points to information the decoder does not have. Another example of memory dependence is filter coefficient interpolation (used to smooth the transitions between different synthesis filters, especially for voiced signals). If filter coefficients for a frame are lost, the filter coefficients for subsequent frames may have incorrect values.

Decoders use various techniques to conceal errors due to packet losses and other information loss, but these concealment techniques rarely conceal the errors fully. For example, the decoder repeats previous parameters or estimates parameters based upon correctly decoded information. Lag information is very sensitive, however, and such techniques are not particularly effective for concealment.

In most cases, decoders eventually recover from errors due to lost information. As packets are received and decoded, parameters are gradually adjusted toward their correct values. Quality is likely to be degraded until the decoder can recover the correct internal state, however. In many of the most efficient speech codecs, playback quality is degraded for an extended period of time (e.g., up to a second), causing high distortion and often rendering the speech unintelligible. Recovery times are faster when a significant change occurs, such as a silent frame, as this provides a natural reset point for many parameters.

This memory dependence problem is described in the article by Andersen et al., entitled "ILBC—a Linear Predictive Coder with Robustness to Packet Losses," Proc. IEEE Workshop on Speech Coding, 2002, pp. 23-25 (2002) ["Andersen article"]. The Andersen article suggests remedying the memory dependence problem by using "frame-independent long-term prediction." The codec operates on 240-sample frames. For every frame, the encoder computes LPC filter coefficients and uses interpolation for the filter coefficients. For each frame, a residual signal is computed and split into 6 40-sample sub-frames. 57 samples of the two consecutive sub-frames with the highest residual energy are encoded sample-by-sample as a "start state vector" at the frame-level. The remaining samples of the frame are encoded at the sub-frame level with reference to the start state vector (and potentially other previously decoded samples) in the same frame. In this way, the codec avoids dependencies across frame boundaries from delay-type prediction of residual signals. On the other hand, by forcing every frame to include a start state vector and have no cross-frame long-term prediction, the codec gives up much of the compression efficiency of long-term prediction. Moreover, the codec is inflexible in that every frame includes a frame-level start state vector and predicted sub-frames without cross-frame prediction, even when network conditions do not warrant such cautious encoding measures. Further, while addressing memory dependencies due to cross-frame prediction of residual signals, the codec still interpolates filter coefficients for every frame, which can lead to problems when the information for a given frame is lost.

Memory dependence problems for line spectrum frequency ["LSF"] parameters in speech codecs are described in the article by Wang et al, entitled "Performance Comparison of Intraframe and Interframe LSF Quantization in Packet Networks," Proc. IEEE Workshop on Speech Coding, 2000, pp. 126-128 (2000). This article does not address the more general problem of memory dependence for packets with information such as excitation signal parameters.

Outside of the area of speech compression, various video codec standards and products use a mixture of intra frames and predicted frames to code and decode video.

B. Inefficient FEC in Dynamic Network Conditions

Various speech codecs use forward error correction ["FEC"] to address loss of encoded information. In general, the term FEC refers to a class of techniques for controlling errors in a system. FEC involves sending extra information along with primary information. The extra information can be used by the receiver, if necessary, to correct or replace corresponding primary information if the primary information is lost.

Some speech codecs have implemented FEC by re-encoding speech information with new parameters. Re-encoding involves encoding with the same or different codecs, and sending the speech multiple times for different quality levels/bitrates. If the highest rate copy is received, then it is used for decoding. Otherwise, the decoder utilizes a lower rate copy it receives. This FEC technique consumes extra encoder-side resources and can lead to problems in switching between the different sets of content. Moreover, it does not adapt fast enough for many real-time applications, nor does it use codec-dependent knowledge or information about the dynamic state of the encoder to regulate FEC. One multiple-codec recovery technique is described in the article by Morinaga et al., entitled "The Forward-Backward Recovery Sub-Codec (FB-RSC) Method: A Robust Form of Packet-Loss Concealment for Use in Broadband IP Networks," Proc. IEEE Workshop on Speech Coding, 2002, pp. 62-64 (2002)

Other speech codecs repeat encoded frames in different packets such that any received packet can be used to decode the frame. The Lakaniemi and Johansson articles describe speech codecs that have implemented FEC by repetition of packets of previously encoded information. Packet repetition is simple and does not consume many additional processing resources, but it doubles transmission rate. If information is lost because of a temporary network bandwidth shortage or condition problem, sending the same packet multiple times can exacerbate the problem and hurt overall quality.

The Johansson article also describes a "partial redundancy" FEC mode for repeating the most important coded speech bits, depending on channel quality and estimated improvement over default concealment methods. This partial redundancy mode does not adequately consider currently available bandwidth, and does not provide multiple sets of partially redundant information to account for loss of consecutive packets.

Some streaming audio applications and non-real-time audio applications use re-transmission or stream switching. Low latency is a criterion of real-time communication, however, and re-transmission and switching schemes are not feasible for that reason.

C. Inefficient Rate Control in Dynamic Network Conditions

Existing speech codecs are mainly fixed-rate and do not provide adequate adaptability. Some existing speech codecs choose bitrate dynamically according to the characteristics of the input signal to accommodate a fixed network bandwidth target.

Other speech codecs adapt the rate of encoded output. AMR is a variable rate codec, and can adapt rate to the complexity of the input signal, network noise conditions, and/or network bandwidth. See the Salami and Makinen articles. Various real-time voice codecs from Microsoft Corporation switch between different codec modes to change rate for different kinds of content. See U.S. Patent Application Publication No. 2003/0101050 to Khalil et al. and U.S. Pat. No. 6,658,383 to Koishida et al. The transition between frames coded at different qualities may not be smooth in some cases, however, and previous speech codecs do not adequately account for smoothness in transitions between quality levels.

As noted, various previous codecs react to network conditions by changing quality and bitrate, but still focus on primary encoding efficiency (reconstruction quality for given bitrate assuming no losses.). These codecs do not adequately consider currently available bitrate and do not integrate FEC with rate control so as to allow adaptation of the emphasis given to FEC vs. primary encoding efficiency, for a given number of available bits for encoding. The Johansson article describes selecting between modes for frame redundancy, "selective redundancy" for sensitive frames, and "partial redundancy," depending on decoder feedback regarding packet losses. These mode selection decisions do not, however, take into account the amount of available bits given bandwidth estimates and the complexity and content of a current frame.

SUMMARY

In summary, various strategies for rate/quality control and loss resiliency in an audio codec are described. For example, a real-time speech codec uses intra-frame coding/decoding, adaptive multi-mode forward error correction ["FEC"], and rate/quality control techniques. These allow the speech codec to adapt seamlessly to changing network conditions while providing efficient and reliable performance. The various strategies can be used in combination or independently.

According to a first strategy, an audio processing tool such as a real-time speech encoder or decoder processes frames for an audio signal. The frames include a mix of intra frames and predicted frames. A predicted frame can use long-term prediction from outside the predicted frame, but an intra frame uses no long-term prediction from outside the intra frame. The intra frames help a decoder recover quickly from packet losses, improving the quality of communications over unreliable packet-switched networks such as the Internet. At the same time, compression efficiency is still emphasized with the predicted frames. Various strategies for inserting intra frames and signaling intra/predicted frames are also described.

According to another strategy, a tool processes primary encoded information for a frame and one or more versions of FEC information for the frame. The primary encoded information includes multiple linear prediction parameter values. Based at least in part on an estimate of extra available bits, a particular version of the FEC information includes a subset of the parameter values. With this strategy, an encoder can efficiently and quickly provide a level of FEC that takes into account the bits currently available for FEC. Various strategies for providing multiple versions of FEC information and predictively encoding/decoding FEC information are also described.

According to another strategy, an encoder-side audio processing tool encodes frames of an audio signal. The encoder estimates the number of extra available bits for a segment after basic encoding and uses at least some of the extra available bits for FEC. In this way, the encoder can adapt FEC to available bandwidth. Various other rate/quality control strategies and FEC control strategies are also described.

The various features and advantages of the invention will be made apparent from the following detailed description of embodiments that proceeds with reference to the accompanying drawings.

DETAILED DESCRIPTION

Figure 1:
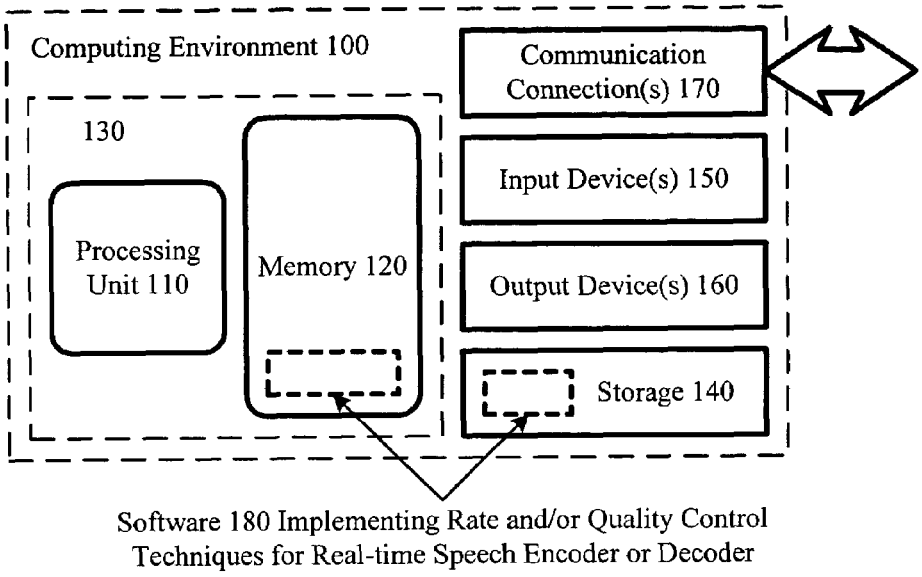
FIG. 1 is a block diagram of a suitable computing environment in which described embodiments may be implemented.

Described embodiments are directed to techniques and tools for processing audio information in encoding and decoding. With these techniques a real-time speech codec seamlessly adapts to changing network conditions. By tracking available network bandwidth, delay, and losses (due to congestion and/or noise), the codec is able to change between different modes to improve quality. In particular, the codec achieves the desired adaptability by using adaptive, multi-mode FEC, adaptive intra frame insertion, and rate control driven by network conditions and feedback from the receiver.

In various embodiments, a real-time speech encoder processes speech during encoding, and a real-time speech decoder processes speech during decoding. The real-time speech encoder and decoder are capable of operating under accepted delay constraints for live, multi-way communication, but can also operate under looser constraints. Uses of the real-time speech codec include, but are not limited to, voice over IP and other packet networks for telephony, one-way communication, and other applications. The real-time speech codec may be integrated into a variety of devices, including personal computers, game console systems, and mobile communication devices. While the speech processing techniques are described in places herein as part of a single, integrated system, the techniques can be applied separately, potentially in combination with other techniques. In alternative embodiments, an audio processing tool other than a real-time speech encoder or real-time speech decoder implements one or more of the techniques.

In some embodiments, an encoder or decoder processes a speech signal separated into frames. A frame is a set of samples over a period of time, such as 160 samples for a 20-millisecond window of 8 KHz audio or 320 samples for a 20-millisecond window of 16 KHz audio. A frame may include one or more constituent frames (sub-frames) or itself be a constituent of a higher-level frame (a super-frame), and a bitstream includes corresponding levels of organization for the parameters associated with the super-frames, frames, sub-frames, etc. In many respects, a frame with sub-frames is conceptually equivalent to a super-frame with constituent frames. The term "frame" as used herein encompasses a set of samples at a level of a hierarchy (with associated frame-level parameters), and the terms "sub-frame" and "super-frame" encompass a subset and superset, respectively, of the "frame" samples (with corresponding bitstream parameters).

Although operations for the various techniques are described in a particular, sequential order for the sake of presentation, it should be understood that this manner of description encompasses minor rearrangements in the order of operations, unless a particular ordering is required. For example, operations described sequentially may in some cases be rearranged or performed concurrently. Moreover, for the sake of simplicity, flowcharts may not show the various ways in which particular techniques can be used in conjunction with other techniques.

I. Computing Environment

FIG. 1 illustrates a generalized example of a suitable computing environment (100) in which described embodiments may be implemented. The computing environment (100) is not intended to suggest any limitation as to scope of use or functionality of the invention, as the present invention may be implemented in diverse general-purpose or special-purpose computing environments.

With reference to FIG. 1, the computing environment (100) includes at least one processing unit (110) and memory (120). In FIG. 1, this most basic configuration (130) is included within a dashed line. The processing unit (110) executes computer-executable instructions and may be a real or a virtual processor. In a multi-processing system, multiple processing units execute computer-executable instructions to increase processing power. The memory (120) may be volatile memory (e.g., registers, cache, RAM), non-volatile memory (e.g., ROM, EEPROM, flash memory, etc.), or some combination of the two. The memory (120) stores software (180) implementing rate control, quality control, and/or loss resiliency techniques for a real-time speech encoder or decoder.

A computing environment (100) may have additional features. In FIG. 1, the computing environment (100) includes storage (140), one or more input devices (150), one or more output devices (160), and one or more communication connections (170). An interconnection mechanism (not shown) such as a bus, controller, or network interconnects the components of the computing environment (100). Typically, operating system software (not shown) provides an operating environment for other software executing in the computing environment (100), and coordinates activities of the components of the computing environment (100).

The storage (140) may be removable or non-removable, and includes magnetic disks, magnetic tapes or cassettes, CD-ROMs, CD-RWs, DVDs, or any other medium which can be used to store information and which can be accessed within the computing environment (100). The storage (140) stores instructions for the software (180).

The input device(s) (150) may be a touch input device such as a keyboard, mouse, pen, or trackball, a voice input device, a scanning device, network adapter, or another device that provides input to the computing environment (100). For audio, the input device(s) (150) may be a sound card, microphone or other device that accepts audio input in analog or digital form, or a CD/DVD reader that provides audio samples to the computing environment (100). The output device(s) (160) may be a display, printer, speaker, CD/DVD-writer, network adapter, or another device that provides output from the computing environment (100).

The communication connection(s) (170) enable communication over a communication medium to another computing entity. The communication medium conveys information such as computer-executable instructions, compressed speech information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (100), computer-readable media include memory (120), storage (140), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Network Environment and Real-Time Speech Codec

Figure 2:
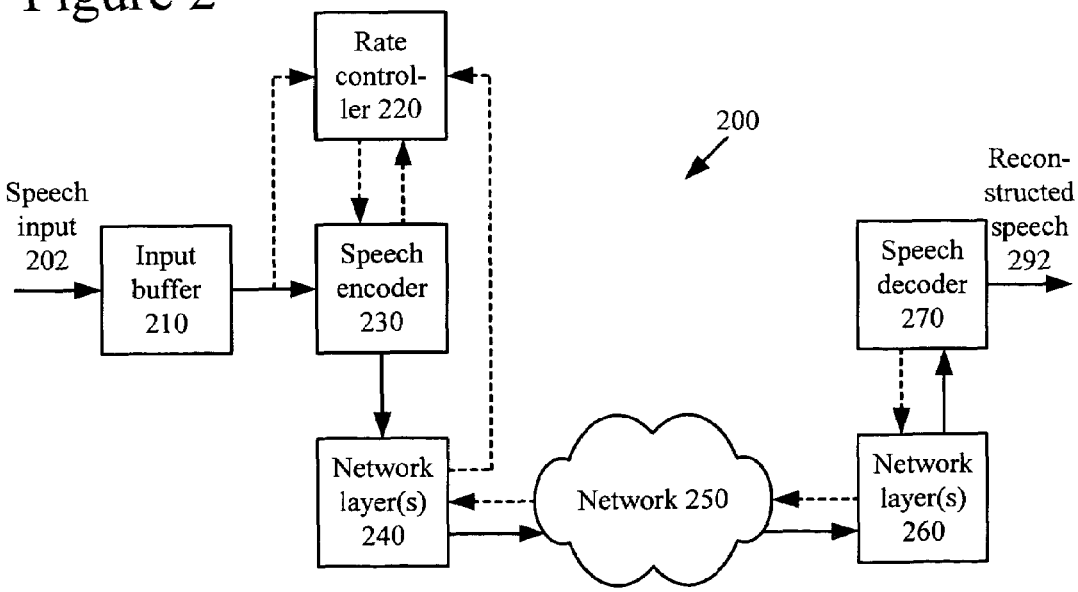
FIG. 2 is a block diagram of a network environment in conjunction with which described embodiments may be implemented.

FIG. 2 is a block diagram of a generalized network environment (200) in conjunction with which described embodiments may be implemented. A network (250) separates various encoder-side components from various decoder-side components.

The primary functions of the encoder-side and decoder-side components are speech encoding and decoding, respectively. On the encoder side, an input buffer (210) accepts and stores speech input (202). The speech encoder (230) takes speech input (202) from the input buffer (210) and encodes it, producing encoded speech. One generalized real-time speech encoder is described below with reference to FIG. 3, but other speech encoders may instead be used.

The encoded speech is provided to software for one or more networking layers (240), which process the encoded speech for transmission over the network (250). For example, the network layer software packages frames of encoded speech information into packets that follow the RTP protocol, which are relayed over the Internet using UDP, IP, and various physical layer protocols. Alternatively, other and/or additional layers of software or networking protocols are used. The network (250) is a wide area, packet-switched network such as the Internet. Alternatively, the network (250) is a local area network or other kind of network.

On the decoder side, software for one or more networking layers (260) receives and processes the transmitted data. The network, transport, and higher layer protocols and software in the decoder-side networking layer(s) (260) usually correspond to those in the encoder-side networking layer(s) (240). The networking layer(s) provide the encoded speech information to the speech decoder (270), which decodes it and outputs speech output (292). One generalized real-time speech decoder is described below with reference to FIG. 4, but other speech decoders may instead be used.

Aside from these primary encoding and decoding functions, the components also share information (shown in dashed lines in FIG. 2) to control the rate, quality, and/or loss resiliency of the encoded speech. The rate controller (220) considers a variety of factors such as the complexity of the current input in the input buffer (210), the buffer fullness of output buffers in the encoder (230) or elsewhere, desired output rate, the current network bandwidth, network congestion/noise conditions and/or decoder loss rate. The decoder (270) feeds back decoder loss rate information to the rate controller (220). The networking layer(s) (240, 260) collect or estimate information about current network bandwidth and congestion/noise conditions, which is fed back to the rate controller (220). Alternatively, the rate controller (220) considers other and/or additional factors.

The rate controller (220) directs the speech encoder (230) to change the rate, quality, and/or loss resiliency with which speech is encoded. The encoder (230) may change rate and quality by adjusting quantization factors for parameters or changing the resolution of entropy codes representing the parameters. As further described below, the encoder may change loss resiliency by adjusting the rate of intra frames of speech information or by changing the allocation of bits between FEC and primary encoding functions.

Figure 3:
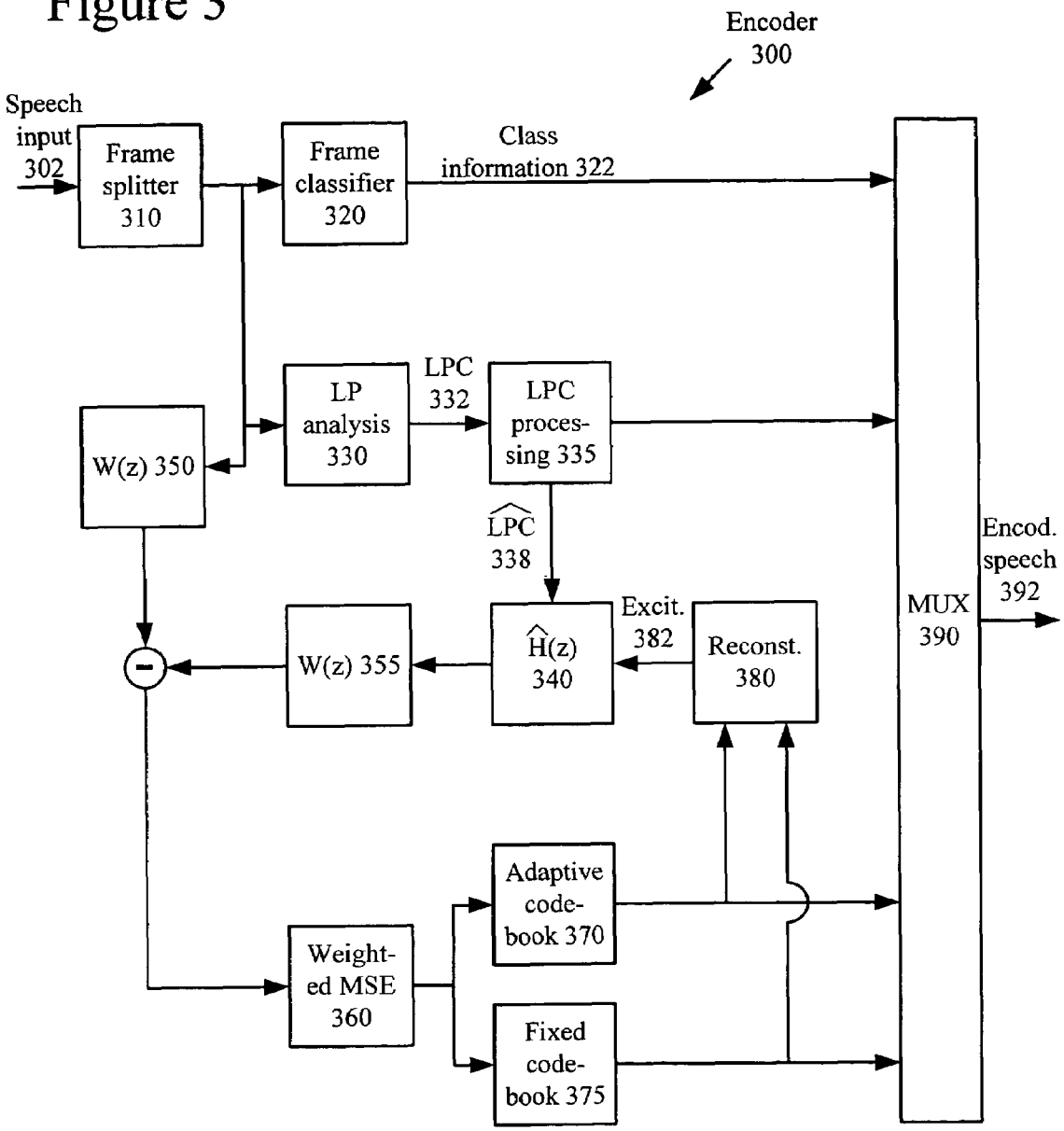
FIG. 3 is a block diagram of a real-time speech encoder in conjunction with which described embodiments may be implemented.

FIG. 3 is a block diagram of a generalized real-time speech encoder (300) in conjunction with which described embodiments may be implemented. The encoder (300) accepts speech input (302) and produces encoded speech output (392) from a bitstream multiplexer ["MUX"] (390).

The frame splitter (310) splits the samples of the speech input (302) into frames. In one implementation, the frames are uniformly 20 milliseconds long—160 samples for 8 KHz input and 320 samples for 16 KHz input. In other implementations, the frames have different durations, are non-uniform or overlapping, and/or the sampling rate of the input (302) is different. The frames may be organized in a super-frame/frame, frame/sub-frame, or other configuration for different stages of the encoding and decoding.

The frame classifier (320) classifies the frames according to one or more criteria, such as energy of the signal, zero crossing rate, long-term prediction gain, gain differential, and/or other criteria for sub-windows or the whole frames. Based upon the criteria, the frame classifier (320) classifies the different frames into classes such as silent, unvoiced, voiced, and transition (e.g., unvoiced to voiced). In some embodiments, voiced and transition frames are further classified as either "intra" or "predicted," as described below. The frame class affects the parameters that will be computed to encode the frame. In addition, the frame class may affect the resolution and loss resiliency with which parameters are encoded, so as to provide more resolution and loss resiliency to more important frame classes and parameters. For example, silent frames are coded at very low rate, are very simple to recover by concealment if lost, and may not need protection against loss. Unvoiced frames are coded at slightly higher rate, are reasonably simple to recover by concealment if lost, and are not significantly protected against loss. Voiced frames are usually encoded with more bits, depending on the complexity of the frame as well as the presence of transitions. Voiced frames are also difficult to recover if lost, and so are more significantly protected against loss. Alternatively, the frame classifier (320) uses other and/or additional frame classes.

The LP analysis component (330) computes linear prediction coefficients (332). In one implementation, the LP filter uses 10 coefficients for 8 KHz input and 16 coefficients for 16 KHz input, and the LP analysis component (330) computes one set of linear prediction coefficients per frame. Alternatively, the LP analysis component (330) computes two sets of coefficients per frame, one for each of two windows centered at different locations, or computes a different number of coefficients per filter and/or per frame.

The LPC processing component (335) receives and processes the linear prediction coefficients (332). Typically, the LPC processing component (335) converts LPC values to a different representation for more efficient quantization and encoding. For example, the LPC processing component (335) converts LPC values to a line spectral pair ["LSP"] representation, and the LSP values are quantized and encoded. The LSP values may be intra coded or predicted from other LSP values. Various representations, quantization techniques, and encoding techniques are possible for LPC values. The LPC values are provided in some form to the MUX (390) for packetization and transmission (along with any quantization parameters and other information needed for reconstruction). For subsequent use in the encoder (300), the LPC processing component (335) reconstructs the LPC values. The LPC processing component (335) may perform interpolation for LPC values (such as equivalently in LSP representation or another representation) to smooth the transitions between different sets of LPC coefficients, or between the LPC coefficients used for different sub-frames of frames.

The synthesis (or "short-term prediction") filter (340) accepts reconstructed LPC values (338) and incorporates them into the filter. The synthesis filter (340) computes predicted values for samples using the filter and previous samples. For a given frame, the synthesis filter (340) may buffer a number of reconstructed samples (e.g., 10 for a 10-tap filter) from the previous frame for the start of the prediction.

The perceptual weighting components (350, 355) apply perceptual weighting to the original signal and the modeled output of the synthesis filter (340) so as to selectively remove or de-emphasize components of the signal whose removal/de-emphasis will be relatively unobjectionable. The perceptual weighting components (350, 355) exploit psychoacoustic phenomena such as masking. In one implementation, the perceptual weighting components (350, 355) apply weights based on the original LPC values (332). Alternatively, the perceptual weighting components (350, 355) apply other and/or additional weights.

Following the perceptual weighting components (350, 355), the encoder (300) computes the difference between the perceptually weighted original signal and perceptually weighted output of the synthesis filter (340). Alternatively, the encoder (300) uses a different technique to compute the residual.

The excitation parameterization component (360) (shown as "weighted MSE" in FIG. 3) models the residual signal as a set of parameters. It finds the best combination of adaptive codebook indices and fixed codebook indices in terms of minimizing the difference between the perceptually weighted original signal and perceptually weighted synthesized signal (in terms of weighted mean square error or other criteria). Many parameters are computed per sub-frame, but more generally the parameters may be per super-frame, frame, or sub-frame. Table 2 shows the parameters for different frame classes in one implementation.

TABLE 2

| | Parameters for different frame classes |
|---|---|
| Frame class | Parameter(s) |
| Silent | Class information; LSP; gain (per frame, for generated noise) |
| Unvoiced | Class information; LSP; gain, amplitudes and signs for remainder (per sub-frame) |
| Voiced | Class information; LSP; pitch and gain (per sub-frame); |
| Transition | gain, amplitudes and signs for remainder (per sub-frame) |

For voiced frames in particular, a typical excitation signal is characterized by a periodic pattern. As such, the excitation parameterization component (360) divides the frame into sub-frames and computes a pitch value per sub-frame using long-term prediction. The pitch value indicates an offset or lag into previous excitation cycles from which the excitation signal in the sub-frame is predicted. The pitch gain value (also per sub-frame) indicates a multiplier to apply to the pitch-predicted values, to adjust the scale of the values. After pitch-prediction and gain correction, the remainder of the excitation signal (if any) is selectively represented as amplitudes and signs, as well as gains to apply to the remainder values. Alternatively, the component (360) computes other and/or additional parameters for the excitation signal.

The adaptive codebook (370) and fixed codebook (375) encode the parameters representing the excitation signal. The adaptive codebook (370) adapts to patterns and probabilities in the parameters it encodes; the fixed codebook uses a predefined model for the parameters it encodes. In one implementation, the adaptive codebook (370) encodes pitch and pitch gain values, and the fixed codebook (375) encodes other gains, amplitudes and signs for remainder samples. Alternatively, the encoder uses another configuration of codebooks for entropy encoding parameters for the excitation signal.

Codebook indices for the excitation signal are provided to the reconstruction component (380) as well as the MUX (390). The bitrate of the output (392) depends on the indices used by the codebooks (370, 375), and the encoder (300) may control bitrate and/or quality by switching between different sets of indices in the codebooks, using embedded codes, coding more or fewer remainder samples, or using other techniques. The codebooks (370, 375) may be included in a loop with or integrated into the excitation parameterization component (360) to integrate the codebooks with parameter selection and quantization.

The excitation reconstruction component (380) receives indices from the codebooks (370, 375) and reconstructs the excitation from the parameters. The reconstructed excitation signal (382) is fed back to the synthesis filter (340), where it is used to reconstruct the "previous" samples from which subsequent linear prediction occurs.

The MUX (390) accepts parameters. In FIG. 3, the parameters include frame class (potentially with intra and predicted frame information), some representation of LPC values, pitch, gain, and amplitudes and signs for remainder values. The MUX (390) constructs application layer packets to pass to other software, or the MUX (390) puts data in the payloads of packets that follow a protocol such as RTP. The MUX may buffer parameters so as to allow selective repetition of the parameters for forward error correction in later packets, as described below. In one implementation, the MUX (390) packs into a single packet the primary encoded speech information for one frame, along for forward error correction versions of one or more previous frames, but other implementations are possible.

The MUX (390) provides feedback such as current buffer fullness for rate control purposes. More generally, various components of the encoder (300) (including the frame classifier (320) and MUX (390)) may provide information to a rate controller such as the one shown in FIG. 2. Using this and/or other information, the rate controller directs various components of the encoder (300) (including the parameterization component (360), codebooks (370, 375), LPC processing component (335), and MUX (390)) so as to affect the rate, quality, and/or loss resiliency of the encoded speech output (392).

Figure 4:
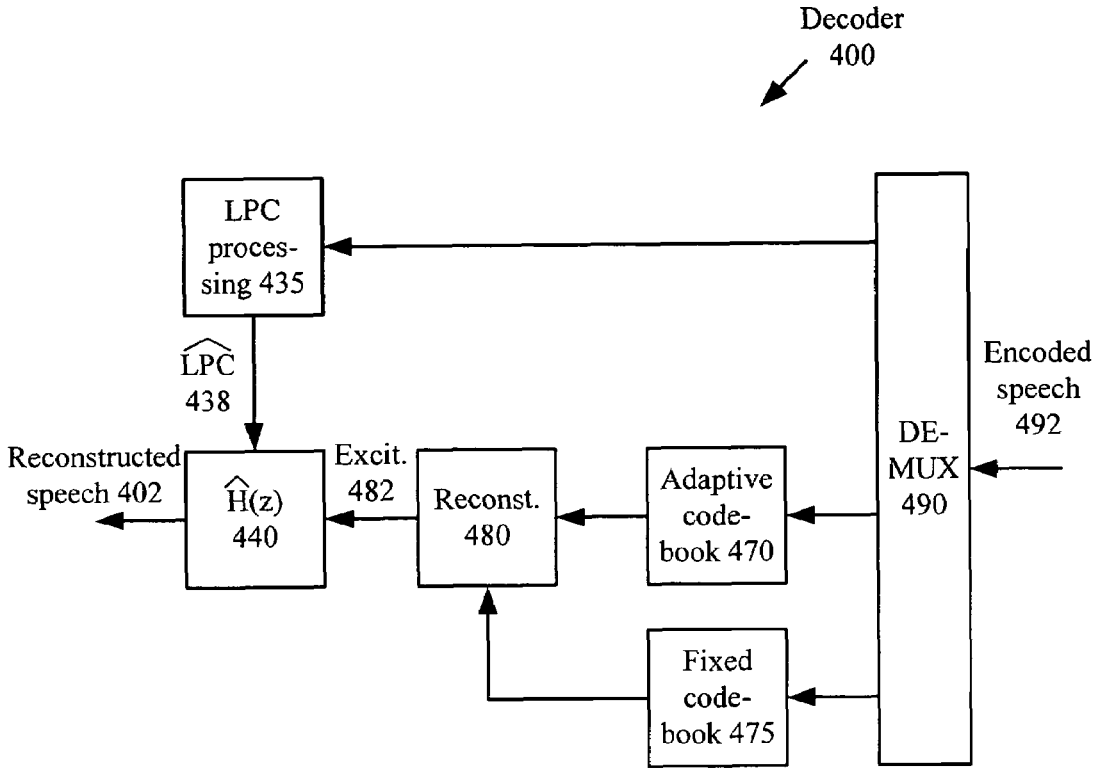
FIG. 4 is a block diagram of a real-time speech decoder in conjunction with which described embodiments may be implemented.

FIG. 4 is a block diagram of a generalized real-time speech decoder (400) in conjunction with which described embodiments may be implemented. The decoder (400) accepts encoded speech information (492) as input and produces reconstructed speech (402) after decoding. The components of the decoder (400) have corresponding components in the encoder (300), but overall the decoder (400) is simpler since it lacks components for perceptual weighting, the excitation processing loop and rate control.

A bitstream demultiplexer ["DEMUX"] (490) accepts the encoded speech information (492) as input and parses it to identify and process parameters. In FIG. 4, the parameters include frame class (potentially with intra and predicted frame information), some representation of LPC values, pitch, gain, and amplitudes and signs for remainder values.

The frame class indicates which other parameters are present for a given frame. More generally, the DEMUX (490) uses the protocols used by the encoder (300) and extracts the parameters the encoder (300) packs into packets. For packets received over a dynamic packet-switched network, the DEMUX (490) includes a jitter buffer to smooth out short term fluctuations in packet rate over a given period of time. The jitter buffer is filled at a variable rate and depleted by the decoder (400) at a constant or relatively constant rate.

The DEMUX (490) may receive multiple versions of parameters for a given segment, including a primary encoded version and one or more forward error correction versions, as described below. When the DEMUX does not receive the primary encoded version of information for a segment, the DEMUX waits for a forward error correction version. When error correction fails, the decoder (400) uses concealment techniques such as parameter repetition or estimation based upon information that was correctly received.

The LPC processing component (435) receives information representing LPC values in the form provided by the encoder (300) (as well as any quantization parameters and other information needed for reconstruction). The LPC processing component (435) reconstructs the LPC values using the inverse of the conversion, quantization, encoding, etc. previously applied to the LPC values. The LPC processing component (435) may also perform interpolation for LPC values (in LPC representation or another representation such as LSP) to smooth the transitions between different sets of LPC coefficients.

The adaptive codebook (470) and fixed codebook (475) decode the parameters for the excitation signal. In one implementation, the adaptive codebook (470) decodes pitch and gain values, and the fixed codebook (475) decodes amplitudes and signs for remainder samples. More generally, the configuration and operations of the codebooks (470, 475) correspond to the configuration and operations of the codebooks (370, 375) in the encoder (300).

Codebook indices for the excitation signal are provided to the reconstruction component (480), which reconstructs the excitation from the parameters. The reconstructed excitation signal (482) is fed into the synthesis filter (440).

The synthesis filter (440) accepts reconstructed LPC values (438) and incorporates them into the filter. The synthesis filter (340) computes predicted values using the filter and previously reconstructed samples. The excitation signal is added to the predicted values to form an approximation of the original signal, from which subsequent prediction occurs.

The relationships shown in FIGS. 2-4 indicate general flows of information; other relationships are not shown for the sake of simplicity. Depending on implementation and the type of compression desired, components can be added, omitted, split into multiple components, combined with other components, and/or replaced with like components. For example, in the environment (200) shown in FIG. 2, the rate controller (220) may be combined with the speech encoder (230). Potential added components include a multimedia encoding (or playback) application that manages the speech encoder (or decoder) as well as other encoders (or decoders) and collects network and decoder condition information, and that performs many of the adaptive FEC functions described above with reference to the MUX (390). In alternative embodiments, different combinations and configurations of components process speech information using the techniques described herein.

IV. Robust Real-Time Speech Codec

Rate control, quality control, and loss resiliency techniques improve the performance of a variable-rate, real-time, parameterized speech codec in a variety of network environments. For example, a speech encoder, decoder, or other component in a network environment as in FIGS. 2-4 implements one or more of the techniques. Alternatively, another component implements one or more of the techniques.

A. Intra and Predicted Frames for Speech

In some embodiments, an encoder selectively inserts intra frames among predicted frames during encoding. The intra frames act as reset (or key) frames, which allow a decoder to recover quickly and seamlessly in the event of packet loss. This improves the quality of speech communications over packet-switched networks and imperfect channels in general, even at very high loss rates, while still emphasizing compression efficiency with the predicted frames.

As described above with reference to FIGS. 2-4, speech is encoded into packets that are relayed over a network. Packets are lost for various reasons. Some packets are dropped due to congestion at routers. Other packets are dropped at the decoder side due to delay (e.g., if the packets are received too late for playback). Intra frames allow a decoder to recover its internal state very quickly. To illustrate, if the excitation signal for a predicted frame is represented with pitches and gains for long-term prediction, and indices for amplitudes and signs of remainder samples, packet losses may prevent effective reconstruction using the pitches and gains. An intra frame lacks the pitches and gains used for long-term prediction from another frame, but still has indices for amplitudes and signs of excitation samples. For a given level of quality, overall bitrate is usually higher for intra frames due to increased bitrate for the indices, which represent a higher energy signal.

Traditionally, speech codecs used for real-time communication are designed for simplicity such that there is no (or very limited) memory dependence. In such codecs, information losses are quickly overcome, but the quality of the output for a given bitrate is inferior to more efficient codecs, which use long-term prediction and pure predicted frames and as a result have significant memory dependence. Selective use of intra frames allows speech codecs to exploit memory dependence to achieve compression efficiency while still having resiliency to packet losses. Even at very high loss rates, the intra frames help maintain good quality.

One way to achieve resiliency to packet losses is to insert intra frames into a packet stream at a regular interval. After every x regularly encoded, predicted frames, the encoder inserts an intra frame to create the effect of a codec reset, allowing the decoder to recover quickly. The encoder uses a different encoding technique to encode intra frames since, for example, lag information is not used for the excitation signals of intra frames. The encoder may take other precautions to reduce memory dependence for intra frames. When lag for a predicted frame is longer than a single frame, for example, the encoder inserts multiple consecutive intra frames so as to achieve a full codec reset with the consecutive intra frames. The encoder may scan ahead for one or more frames to detect such lag information. Or, the encoder may preemptively insert consecutive frames to achieve a full reset even for the maximum possible lags. Alternatively, if a predicted frame would include such lag information, the encoder may encode the frame as an intra frame.

Figure 5:
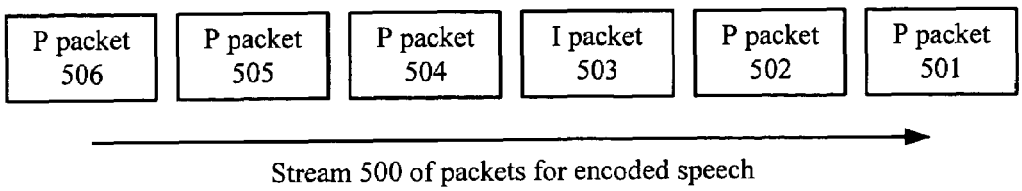
FIG. 5 is a block diagram of a packet stream having a mix of intra and predicted packets of encoded speech.

FIG. 5 shows a packet stream (500) having a mix of intra packets and predicted packets. In FIG. 5, each of the packets includes information for one frame, so the intra packet (503) includes encoded information for one intra frame, and each of the predicted packets (501, 502, 504, 505, 506) includes encoded information for one regular predicted frame. If the first or second predicted packet (501, 502) is lost due to network congestion or noise, the decoder recovers quickly starting at the intra packet (503). The decoder may also use the information in the intra packet (503) for improved error concealment for the lost packet(s). While FIG. 5 shows one frame per packet, alternatively, the packets include information for more than one frame per packet and/or parts of frames per packet.

Figure 6:
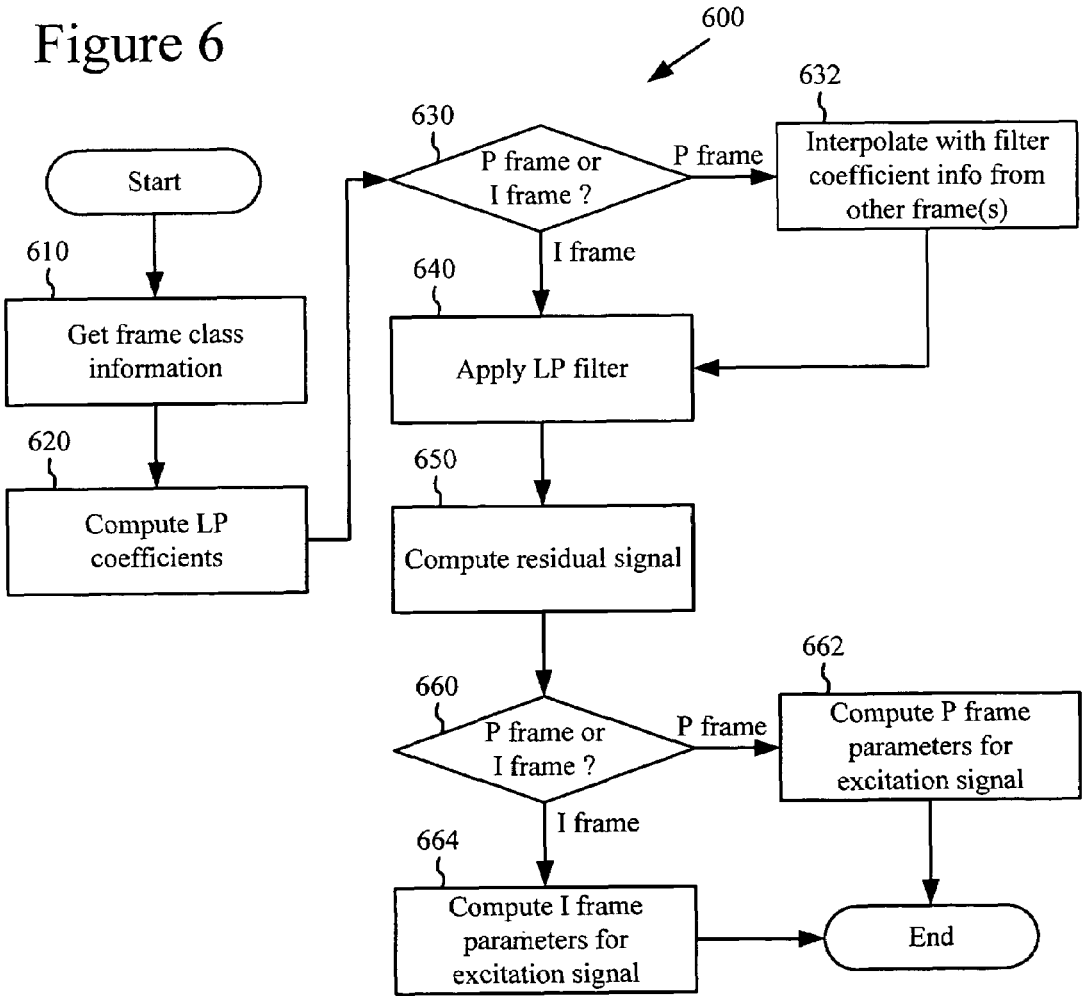
FIG. 6 is a flowchart showing a technique for encoding speech as a mix of intra and predicted frames.

FIG. 6 shows a technique (600) for encoding speech as a mix of intra and predicted frames. The encoder gets (610) frame class information from a component such as a frame classifier and/or rate controller. The frame class information indicates whether to encode the frame as an intra frame or predicted frame, and may indicate other information as well. In some embodiments, only voiced and transition frames include the additional intra/predicted decision information, since packet losses for such frames are harder to conceal effectively and thus more likely to cause extended quality degradation. Silent and unvoiced frames are encoded without regard to intra/predicted mode, as these types of frames do not use pitch parameters or other long-term prediction and are more easily reproduced by error concealment techniques. In the bitstream, the intra/predicted decision information is signaled on a frame-by-frame basis as a single additional bit after other frame class information, or is signaled by some other mechanism (e.g., jointly with frame class information, jointly with frame class and codebook selection information). Alternatively, the encoder makes the intra/predicted decision for other and/or additional classes of frames, or uses different signaling.

The encoder computes (620) LP coefficients for the frame and processes the LP coefficients (not shown). The encoder determines (630) whether the frame is an intra frame or predicted frame. If the frame is a predicted frame, the encoder interpolates (632) filter coefficient information with filter coefficient information from another frame, so as to smooth transitions in coefficient values between the frames. For intra frames, the encoder may skip cross-frame interpolation of filter coefficient information to reduce memory dependence for such information. For either intra or predicted frames, the encoder may perform interpolation for different sets of coefficients within a frame, for example, from sub-frame to sub-frame.

The encoder applies (640) the LP filter. Synthesis filtering for a predicted frame relies on small number (e.g., 10) of reconstructed samples at the end of the previous frame as start state information. In some embodiments, synthesis filtering for an intra frame also relies on such previously reconstructed samples from a previous frame for start state, where the samples are reproduced with error concealment techniques if necessary. This results in some memory dependence for intra frames, but the memory dependence is very limited since the short-term prediction of the synthesis filter is not particularly sensitive to errors in the start state, correcting itself fairly quickly. In other embodiments, synthesis filtering for an intra frame uses a specially coded start state vector for the start of the intra frame or buffer area samples, so as to remove the memory dependence on previous frame samples.

The encoder then computes (650) a residual signal. At another intra/predicted frame decision (660), if the frame is a predicted frame, the encoder computes (662) predicted frame parameters for representing the excitation signal. Otherwise, the encoder computes (664) intra frame parameters for representing the excitation signal. The exact parameters used for the excitation signal for predicted frames and intra frames depend on implementation.

Figure 7:
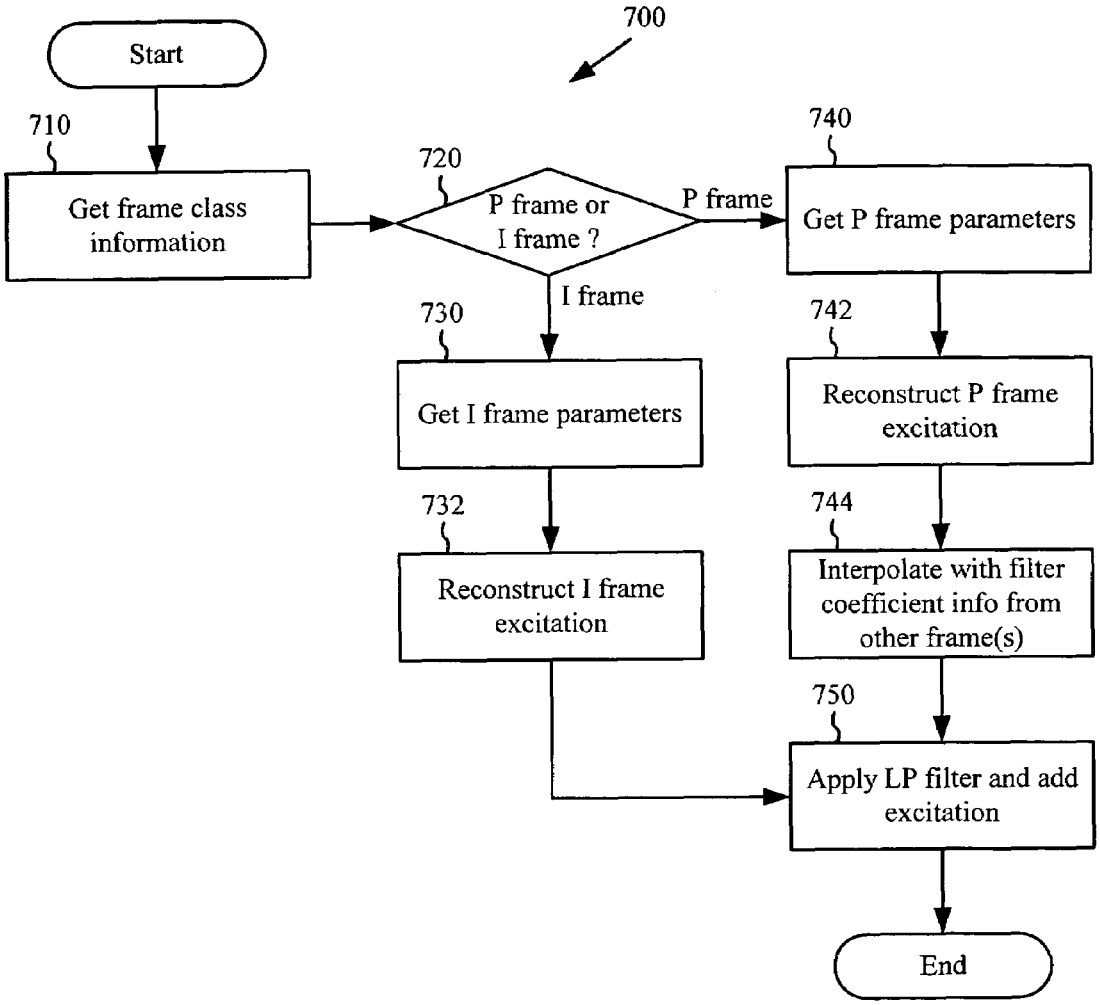
FIG. 7 is a flowchart showing a technique for decoding speech encoded as a mix of intra and predicted frames.

FIG. 7 shows a technique (700) for decoding speech encoded as a mix of intra and predicted frames. The decoder gets (710) frame class information from the bitstream for the encoded speech. The decoder parses the bitstream according to the signaling protocol used by the encoder and decoder. In one implementation, the decoder retrieves frame class information indicating general class (e.g., voiced, unvoiced, silent) for a frame and a single additional bit that signals "intra" or "predicted" for a voiced or transition frame. Alternatively, the decoder gets intra/predicted frame class information for other and/or additional classes of frames, or by another signaling mechanism.

The decoder determines (720) whether the frame is an intra frame or predicted frame. If the frame is a predicted frame, the decoder gets (740) the predicted frame parameters for the frame. The exact parameters used for predicted frames depend on implementation. The decoder reconstructs (742) the excitation signal for the predicted frame from the relevant parameters and interpolates (744) filter coefficient information with filter coefficient information from another frame, so as to smooth transitions in coefficient values between the frames. The decoder may also apply interpolation within a predicted frame for different sets of coefficients.

If the frame is an intra frame, the decoder gets (730) the intra frame parameters for the frame. The exact parameters used for intra frames depend on implementation. Intra frames typically lack pitch values and gain values that require long-term prediction. The decoder reconstructs (732) the excitation signal for the intra frame from the relevant parameters. The decoder may skip cross-frame interpolation of filter coefficient information for intra frames to reduce memory dependence for such information, while still applying interpolation within an intra frame for different sets of LP coefficients.

The decoder then applies (750) the LP filter for the intra or predicted frame and adds the excitation signal for the frame to reconstruct the frame. In some embodiments, synthesis filtering for intra and predicted frames relies on previously reconstructed samples from a previous frame for start state, where the samples are reproduced with error concealment techniques if necessary. In other embodiments, synthesis filtering for an intra frame uses a specially coded start state vector for the start of the intra frame or buffer area samples, so as to remove the memory dependence on previous frame samples.

Many different criteria can be used to determine when to insert intra frames, and intra frame usage can vary dynamically. Intra frames may be introduced at a regular interval (as described below with reference to FIG. 8), at selective times, or on some other basis. For example, the encoder may selectively skip intra frame insertion when it is not needed (e.g., if there are several silent frames that act as natural reset points). Skipping interpolation of coefficient information between an intra frame and the preceding frame can lead to distortion. So, the encoder may change locations of intra frames so as to improve overall quality.

Figure 8:
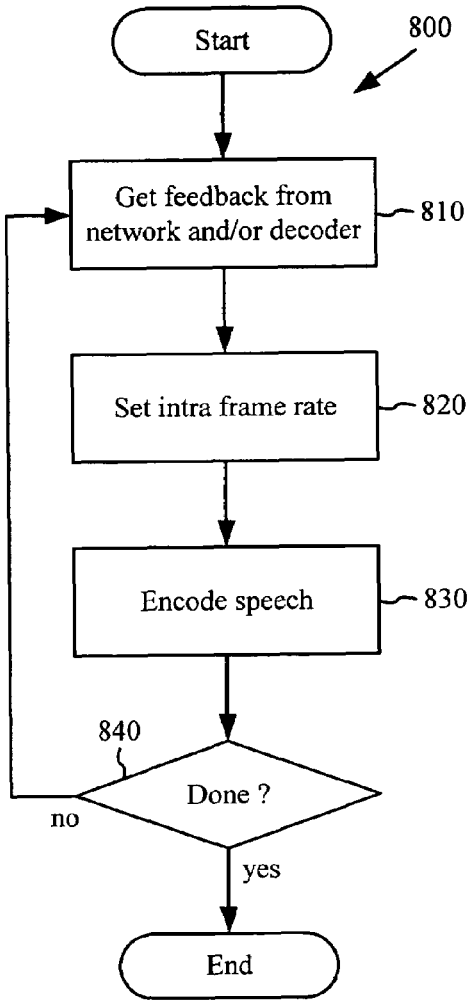
FIG. 8 is a flowchart showing a technique for adjusting intra frame rate in view of feedback from a network and/or decoder.

FIG. 8 shows a technique for adjusting intra frame rate in view of feedback from a network and/or decoder. The encoder gets (810) feedback from a network and/or decoder. The network feedback indicates network bandwidth, network noise condition, and/or network congestion levels. The decoder feedback indicates the number or rate of packets that the decoder has been unable to decode, for one reason or another. Alternatively, the encoder gets other and/or additional feedback.

The encoder then sets (820) the intra frame rate by increasing, decreasing, or maintaining the intra frame rate. The encoder increases intra frame rate when network losses are more likely so as to allow better recovery from packet losses, and decreases intra frame rate when network losses are less likely. While increasing intra frame rate improves resiliency to packet losses, the countervailing concern is that increasing intra frame rate can cause degradation in quality when there are no losses, since intra frames are mostly inferior to predicted frames in terms of pure compression efficiency. The intra frame rate settings are experimentally derived depending on a particular network, codec, and/or content. In one implementation, the encoder sets the intra frame rate as shown in Table 3.

TABLE 3

Intra frame rate related to packet loss rate

| Packet loss rate | Distance between intra frames |
|---|---|
| 0% <= loss rate < 3% | n/a (do not use intra frames) |
| 3% <= loss rate < 5% | 7 |
| 5% <= loss rate < 10% | 5 |
| 10% <= loss rate | 3 |

As Table 3 shows, for ideal network conditions, no intra frames are used. Otherwise, intra frames are periodically inserted. Alternatively, the encoder sets intra frame rate on some other basis.

The encoder encodes (830) speech at the intra frame rate until the encoder finishes. Periodically or on some other basis, the encoder gets (810) more feedback and adjusts (820) the intra frame rate. For example, the encoder checks for feedback after a particular number of frames or seconds, or when alerted by networking layer software, application software, or other software.

B. Adaptive, Multi-Mode FEC

In some embodiments, an encoder adaptively varies forward error correction to protect the output stream against losses. This improves the actual quality of reconstructed speech when varying network conditions are taken into account, and enables intelligible reconstruction even at very high packet loss rates.

Effective protection schemes are needed to address adverse conditions for real-time speech communication over the Internet and other packet-switched networks. Under adverse conditions, packets are delayed or dropped due to network congestion. Existing methods for addressing packet loss are not particularly efficient for real-time communication. At high loss rates, the quality of reconstructed speech can be severely degraded, making communication very difficult. In contrast, adaptive, multi-mode FEC provides effective and reliable performance under a wide range of network conditions.

In a parameterized speech codec, some parameters are more important than other parameters, and some parameters are easier than others to estimate from surrounding information as part of error concealment. In general, the most important information to protect against loss is class information, followed by gain and pitch information. Other information (e.g., linear prediction coefficient information) may be important to reconstruction quality, but can be estimated more successfully with error concealment techniques. At the frame level, some frames are more important than others, and some frames are easier than others to reproduce with error concealment techniques. For example, voiced and transition frames need more loss protection than unvoiced and silent frames.

Figure 9:
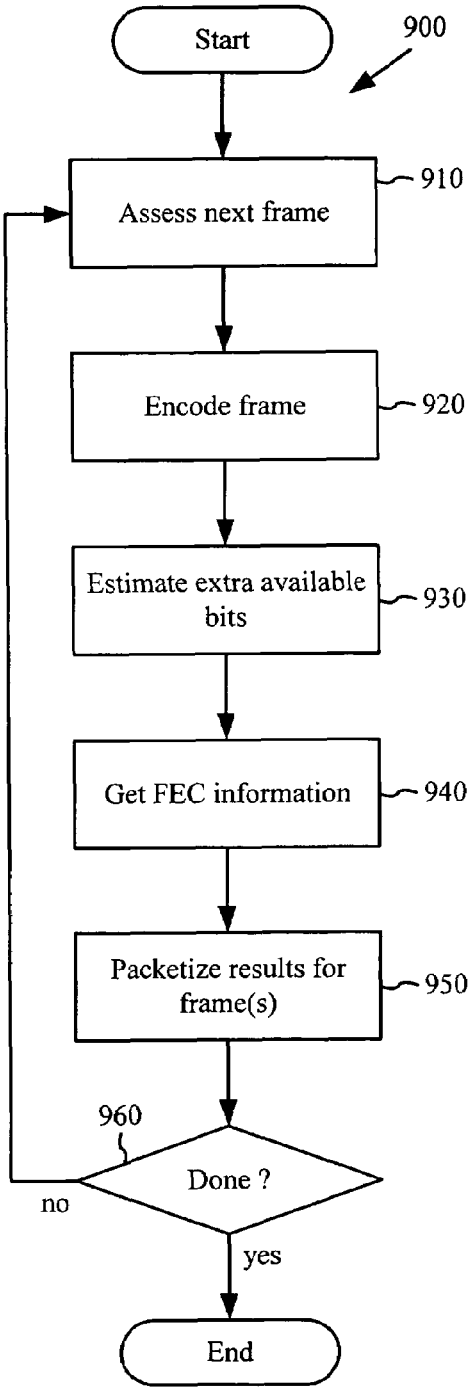
FIG. 9 is a flowchart showing a technique for bandwidth adaptive FEC.

FIG. 9 shows a technique (900) for bandwidth adaptive FEC. The encoder assesses (910) the next frame of speech. For example, for a variable-rate codec, when the encoder classifies the frame, the encoder evaluates the complexity of the frame, determines the relative importance of the frame compared to other frames, and sets a rate allocation for the frame. Alternatively, the encoder considers other and/or additional criteria. The encoder uses this assessment when encoding (920) the frame, and later uses this assessment to decide which frames and parameters need more or less protection against packet loss and other information loss.

The encoder estimates (930) the extra bits available. To do so, the encoder considers current rate status for the encoded frame and neighboring frames, available network bandwidth, and/or other criteria. The extra bits may be devoted to forward error correction, other error resiliency measures, and/or improved quality.

The encoder then gets (940) FEC information, using up some or all of the extra available bits. In doing so, the encoder may select between multiple subsets of previously encoded information, adjust the precision with which previous information is represented, or compute new parameters for a lower rate, lower quality, fewer sub-frames, fewer samples, etc. The encoder gets FEC information for the previous frame, multiple previous frames, or some other frame(s).

The encoder packetizes (950) the results for the frame(s), including the primary encoded information for the frame and the one or more versions of FEC information. For example, the encoder puts FEC information for a previous frame into a packet with the primary encoded information for the current frame. Or, the encoder gets FEC information for two different previous frames to be packed with the primary encoded information for the current frame. Alternatively, the encoder uses another pattern or approach to packetize FEC information and primary encoded information. The encoder then determines (960) whether to continue with the next frame or not.

Figure 10:
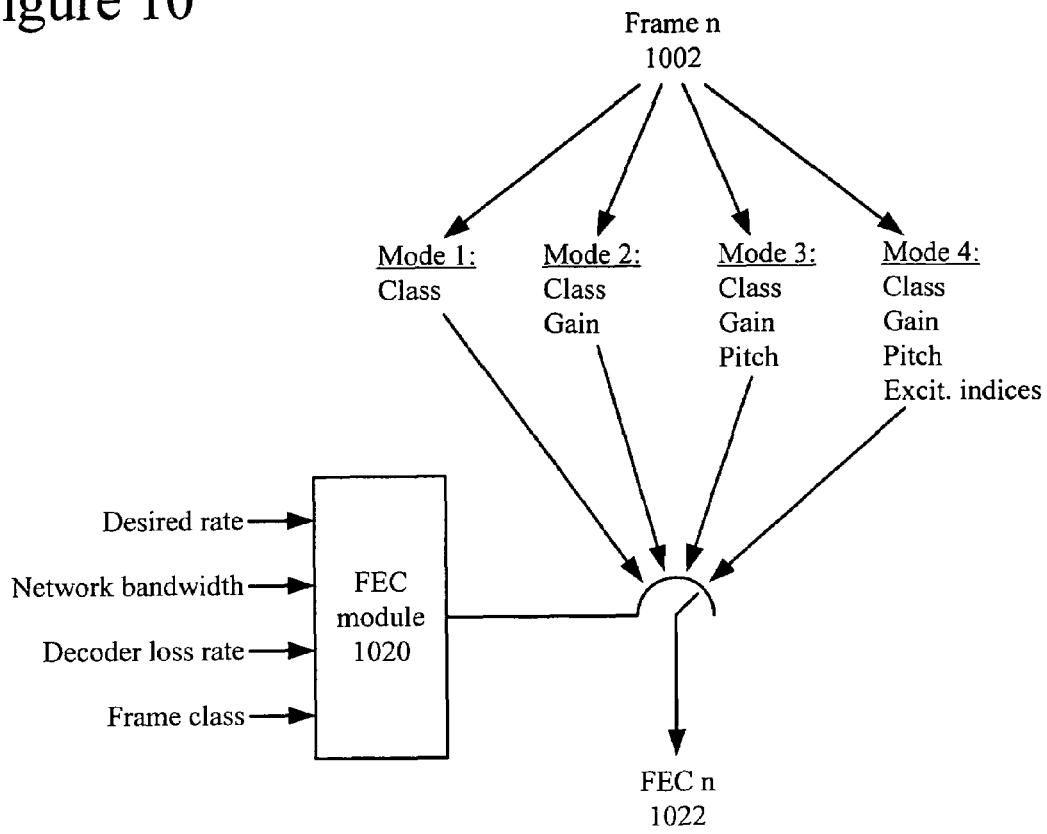
FIG. 10 is a diagram showing mode selection for multi-mode FEC.

FIG. 10 shows a FEC module (1020) for selecting between multiple modes of FEC information. An encoder such as the one shown in FIG. 3 or a different tool includes the FEC module (1020). The FEC module (1020) provides one possible way to adapt FEC information to different circumstances.

The FEC module (1020) takes as input: (1) frame class information, (2) information about available network bandwidth (from network layer software), (3) reported decoder loss rate (which can be fed back on a slow but regular basis from a decoder), and (4) desired operating rate (from a user-level setting or other encoder setting). Alternatively, the FEC module (1020) takes additional and/or other information as input.

The FEC module (1020) then decides which FEC mode to choose for the FEC information (1022) for the frame (1002). FIG. 10 shows four modes having different subsets of parameters for the frame (1002). The first mode includes only class information, which might be adequate information for a silent frame or unvoiced frame. Higher modes include progressively more parameters, for more increasingly more accurate reconstruction of voiced and transition frames. Alternatively, the FEC module switches between more or fewer modes, and/or the modes include different subsets of parameters for the frame (1002), with the number of modes and constituents of the modes being experimentally derived for a particular network, codec, and/or kind of content.

In general, for low FEC modes, the module (1020) FEC protects only class information or gain information, which is difficult to estimate accurately by error concealment. This suffices for silent and unvoiced frames. At intermediate modes, the module (1020) FEC protects more information, such as pitch and excitation remainder indices. At highest modes, the module (1020) FEC protects most information, including linear prediction coefficient information. An increase in network or decoder loss rate causes the module (1020) to increase the amount of FEC information sent so as to be more cautious with respect to losses. Of course, when loss rates are null or negligible, the FEC module (1020) FEC protects no information, as doing so could actually hurt overall quality. The FEC module (1020) may skip FEC protection in other circumstances as well, for example, if there is not enough available bandwidth or if the FEC module (1020) determines that concealment techniques would be effective for particular frame(s) in the event of losses.

Figure 11:
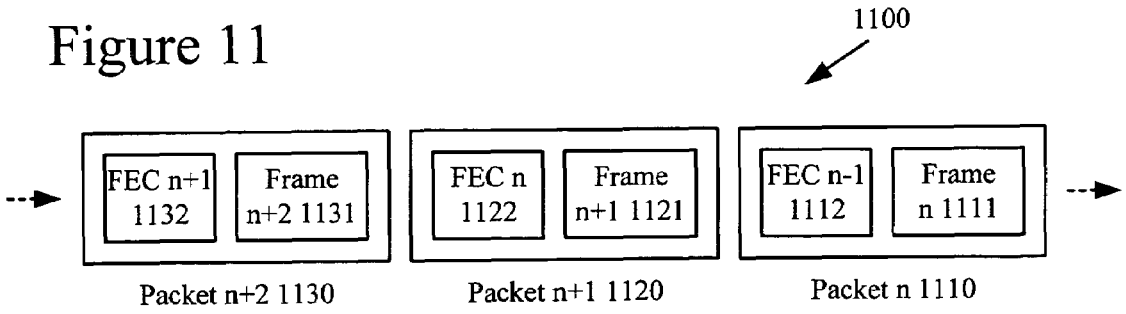
FIG. 11 is a block diagram of a packet stream having a mix of primary encoded information and FEC information.

FIG. 11 shows a packet stream (1100) having a mix of primary encoded information and FEC information. Packet n (1110) includes the primary encoded information for frame n (1111) as well as FEC information for frame n−1 (1112). Packet n+1 (1120) includes the primary encoded information for frame n+1 (1121) as well as FEC information for frame n (1122), and so on.

Alternatively, other patterns and/or approaches are used to packetize FEC information and primary encoded information. For example, a packet includes primary encoded information for multiple frames (such as frame n and frame n+1) as well as FEC information for multiple frames (such as frame n−1 and frame n−2).

FEC protection bits for a given frame are usually sent in the next packet after the primary encoded information for the frame, or slightly later. For the decoder to be able to use the FEC information, the packet including the FEC information must be available to the decoder when the decoder determines that the packet with the primary encoded information is lost, or shortly thereafter. When the decoder has a jitter buffer, the packet with the FEC information should be in the jitter buffer when the packet with the primary encoded information is determined to be lost. Increasing the duration of the jitter buffer can compensate for high network jitter, but this can add unacceptable delay to decoding and playback for real-time communication. If the primary information and FEC information for a frame are lost (or delayed and assumed lost), the decoder employs error concealment to attempt to conceal the absence. The encoder may generate multiple sets of FEC information for each frame, potentially sending each set in a different packet and with a different FEC mode. While this increases the likelihood that at least one version of the frame can be decoded, it adds to overall bitrate. In any case, playback constraints for real-time communication (and for other applications to a lesser extent) limit how far back FEC information can be effectively provided.

C. Predictive Coding of FEC Information

To reduce the bitrate associated with FEC information, the encoder and decoder use predictive coding and decoding of FEC information. This reduces bitrate for FEC information for any parameter that is suitable for prediction, including linear prediction coefficient information such as LSP values. One or more excitation parameters may also be predictively coded.

For FEC information for a first frame (e.g., at time n) and primary encoded information for a second frame (e.g., at time n+1), the encoder predicts the FEC information based upon corresponding information in the primary encoded information. For example, the encoder forms a predictor based upon the primary encoded information and potentially other causal information, computes some form of differential between the relevant FEC information and the predictor, and encodes the differential.

The decoder receives the FEC information for the first frame and the primary encoded information for the second frame, decodes the FEC information for the first frame relative to the primary encoded information. For example, the decoder forms the predictor based upon the primary encoded information and potentially other causal information, decodes the differential for the relevant FEC information, and combines the differential and the predictor in some way.

The FEC information for the first frame is sent later than the primary encoded information for the first frame. The FEC information for the first frame may even be transmitted in the same packet as the primary encoded version of the second frame. If the packet is lost, all of the information is lost. Otherwise, all of the information is delivered to the decoder. When the primary information for a current frame is used to predict FEC information for a previous frame, the prediction is "backward" in time (as opposed to the "forward" in time prediction used in typical prediction schemes).

D. Rate, Quality, and FEC Control

In some embodiments, an encoder controls encoding of speech input responsive to multiple factors. Internal factors may include the complexity of the input, transition smoothness, and/or the desired operating rate. External factors may include network bandwidth, network condition (congestion, noise), and/or decoder feedback. The rate control framework utilizes variable-rate features to significantly improve the quality of communications for a variety of networks, codecs, and content. By incorporating adaptive loss recovery techniques, the rate control framework provides performance that is both efficient and reliable under varying network conditions.

Figure 12:
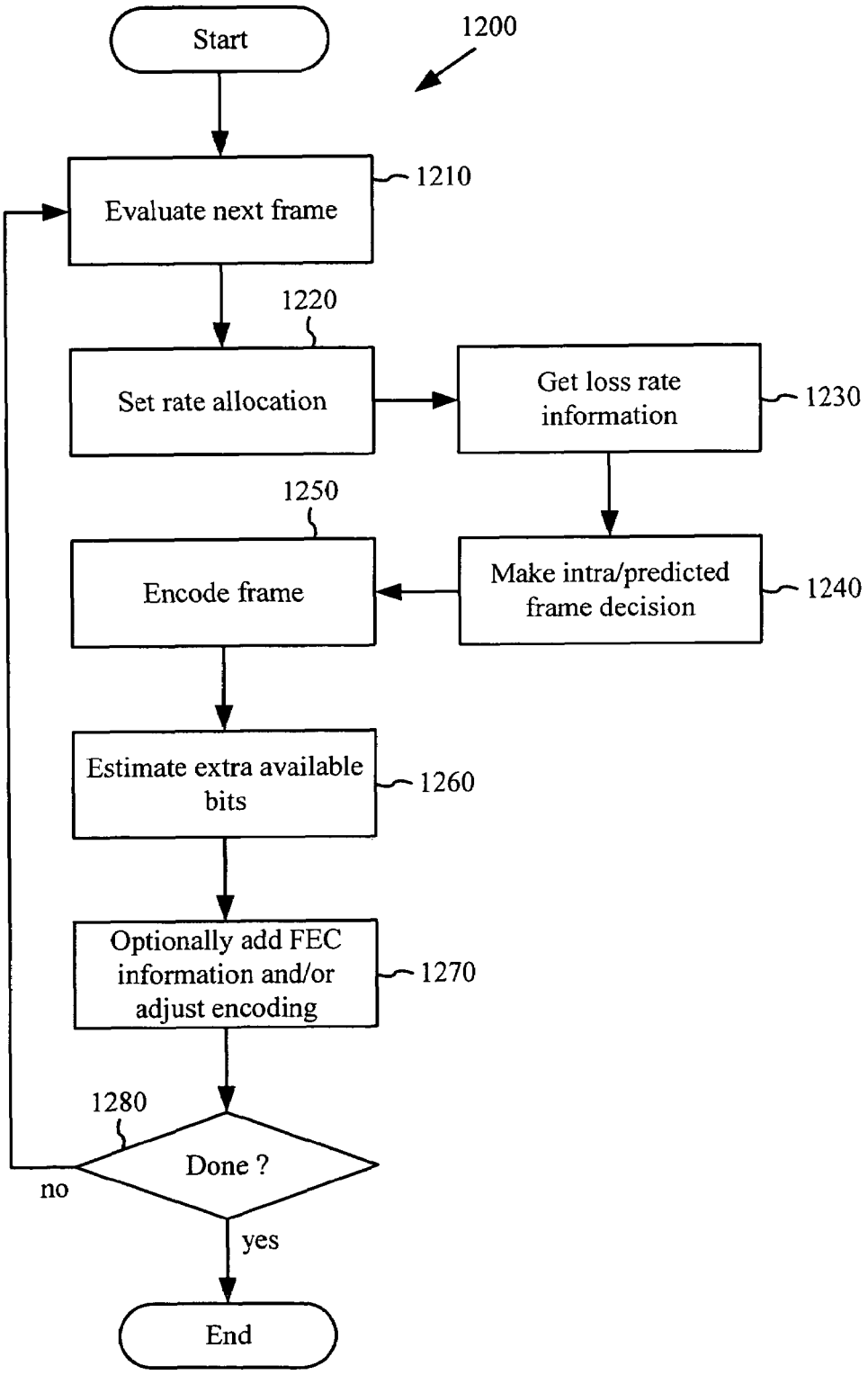
FIG. 12 is a flowchart showing a technique for rate control in a real-time speech encoder based upon multiple internal and external factors.

FIG. 12 shows a technique (1200) for rate control in a real-time speech encoder based upon multiple internal and external factors. The encoder quickly adapts on a frame-by-frame basis to changing network bandwidth. At the same time, the encoder uses loss rate information to select between multiple modes to achieve better packet loss recovery performance. By responding in real time to changes in network conditions and effectively utilizing available bandwidth, the encoder adapts and provides improved quality for different circumstances and times.

Initially, the encoder evaluates (1210) the next frame of speech and sets (1220) a rate allocation for the frame. For example, the encoder considers the complexity of the signal in the frame, the complexity and/or rate of the speech in a segment before and/or after the frame, the desired operating rate, transition smoothness, and currently available network bandwidth. Complexity measurement uses any of a variety of complexity criteria. The desired operating rate is indicated by a user setting, encoder setting, or other source. The encoder gets an estimate of currently available network bandwidth from network layer software, a tool managing the encoder, or another source. The estimate of currently available network bandwidth is updated periodically or on some other basis.

In a variable-rate speech codec, a frame can be encoded at a variety of rates. This is especially true for voiced and transition frames (as opposed to unvoiced frames and silent frames). Unvoiced and silent frames do not require as much bitrate, and typically do not need as much error protection either. Transition frames may require more bitrate than voiced frames (e.g., about 20% more) for additional temporal precision at transient segments. Higher rates usually mean better quality. Due to various constraints (e.g., network bandwidth, desired operating rate), however, some frames may need to be encoded at lower rates. If there is no network bandwidth constraint (e.g., the current overall rate constraint is only due to desired operating rate), then the encoder distributes available rate among frames to maximize overall quality. Complex frames are allocated higher rates than adjacent less complex frames, but the average rate over a period of time should not exceed the desired operating rate, where the period depends on decoder buffer size, delay requirements, or other factors.

By considering network information, the encoder provides better performance under varying network conditions. Network bandwidth estimates may further constrain rate allocated to the frame. The encoder may also consider network congestion and noise rates or reported decoder loss rates when setting (1220) rate allocation. A multi-mode encoder can alter rate allocation dynamically to closely follow time-varying network conditions, with few perceptible effects for the user. This is an improvement over other schemes that switch between different codecs, causing noticeable perceptual effects.

Even with a multi-mode encoder, however, an abrupt change in quality between frames can result in noticeable distortion to the reconstructed speech, often manifested as an audible click between the frames. The encoder addresses this distortion by also considering transition smoothness criteria when setting (1220) a rate allocation for the current frame. This helps smooth out fluctuations in quality that might otherwise be introduced from frame to frame. For example, the encoder adjusts rate allocation for the current frame from an initial allocation, if the change in estimated quality for the current frame relative to a previous frame exceeds a certain threshold. The adjusted rate allocation affects subsequent encoding of the current frame (e.g., in terms of resolution of linear prediction parameters) to bring the quality of the current frame closer to the quality of the previous frame.

The encoder also gets (1230) loss rate information from the network and/or decoder. The encoder gets network information from network layer software, a tool managing the encoder, or another source, and the information is updated periodically or on some other basis. The decoder provides packet loss rate information as feedback to the encoder, a tool managing the encoder, or another source. The encoder then decides (1240) whether to encode the frame as an intra frame or predicted frame. The encoder makes this decision for voiced frames and transition frames, and the loss rate information may affect this decision by causing the encoder to adjust intra frame rate or other intra frame usage, as describe above. Alternatively, the encoder considers other and/or additional information, makes the decision for different kinds of content, or skips the intra/predicted decision.

The encoder encodes (1250) the frame. To change the rate for the frame, the encoder selects between different codebooks for representing coefficient information and/or excitation parameters, otherwise changes the quantization, encoding resolution, etc. with which parameters are represented, changes sampling rate or sub-frame structure, or otherwise modifies the encoding to trade off rate and distortion. The rate allocation for the frame guides the encoding, but the resultant bitrate for the frame may come in below, at, or above the rate allocation in different circumstances. For example, the bitrate for the frame may be below the allocation if a desired quality for the frame is reached before reaching the allocated rate. Or, the bitrate for the frame may be above the allocation if a desired quality is not reached before reaching the allocated rate, in which case the encoder will "borrow" bits from subsequent frames.

The encoder estimates (1260) the number of extra available bits after encoding the frame. For example, the encoder determines the difference between the rate allocation for the frame and the actual resultant bitrate from encoding the frame.

The encoder optionally adds (1270) FEC information and/or adjusts encoding to use some or all of the extra available bits. Thus, the encoder dynamically introduces FEC information into the bitstream depending on rate. The encoder adds FEC information using an adaptive, multi-mode mechanism as described above or using some other mechanism. The encoder adjusts encoding for the frame, for example, by re-encoding at a higher rate or incrementally using extra bits according to an embedded or scalable encoding scheme. In some implementations, the encoder determines how to use the extra bits, and packs primary encoded information together with FEC information. In other implementations, the encoder separately provides primary encoded information and FEC information to another tool, which decides how to use the extra available bits. Also, instead of FEC or quality improvement, the encoder may save the extra available bits for encoding subsequent frames.

There are several different ways for an encoder to use extra available bits. In some embodiments, rate control is separated from error recovery such that the encoded results are unaffected by the availability of extra bandwidth at this point. Suppose the current rate for the codec is $R_c$, and the rate available on the network is $R_n$. In these embodiments, when $R_c<R_n$, the encoder allocates extra available bits to FEC improvement. The codec uses $R_c$ bits for primary encoding and the FEC protection bits consume some or all of the remaining $R_n-R_c$ bits available. Even if the codec does not need all of the $R_c$ bits for primary encoding, the remaining bits still are not used for FEC. One advantage of this approach is that the codec can maintain good performance independent of concerns about sharing bits with FEC. On the other hand, if $R_n$ is close to $R_c$, there may not be enough bits remaining to achieve needed FEC protection.

In other embodiments, the extra available bits are shared between FEC improvement and quality improvement. In these embodiments, when $R_c<R_n$, the encoder increases FEC or increases the quality of the encoded speech, or some combination of the two, within the bounds provided by $R_n$. This is particularly efficient for a variable-rate codec that uses adaptive, multi-mode FEC. In some implementations, the encoder sets an allocation between FEC improvement and quality improvement, and uses the extra available bits according to the allocation. On a frame-by-frame or other basis, the encoder may adjust the allocation in view of the complexity of the content, ease of error concealment, network bandwidth, network congestion, network noise conditions, and/or decoder loss rate feedback. Thus, for example, if a frame is easy to encode and not many bits are needed for it, the encoder tends to devote the extra bits to FEC protection. If error concealment would be effective for a frame, the encoder tends to devote less FEC protection bits to the frame. If loss rates are high, the encoder tends to increase the allocation for FEC protection. On the other hand, if network conditions are good, the encoder tends to avoid devoting too many bits to FEC protection, since doing so would adversely affect the quality of the speech and loss resiliency is less of a concern. There are various ways for an encoder to weigh these criteria, which depend on implementation.

Returning to FIG. 12, the encoder then determines (1280) whether to continue with the next frame or end. While FIG. 12 and the accompanying description involve an encoder reacting to specific factors to encode speech in real time, alternatively an encoder performs rate and FEC control considering other and/or additional factors, on a different kind of content, or under different delay constraints. Moreover, while FIG. 12 shows adaptation on a frame-by-frame basis, alternatively an encoder adapts on some other basis. Finally, FIG. 12 shows a combination of several different rate control strategies, which may instead be used separately or in combination with different rate control strategies.

Having described and illustrated the principles of our invention with reference to described embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In a speech processing tool operated on a computing device, a method comprising:

receiving a frame for a speech signal at the computing device, the frame representing audio samples taken from the speech signal;

processing the frame for the speech signal with the computing device, the processing including processing primary encoded information for the frame and one or more versions of forward error correction information for the frame, wherein the primary encoded information comprises plural parameter values signaled in a bitstream, and wherein each of the one or more versions of forward error correction information comprises a subset of the plural parameter values selected based at least in part on an estimate of extra available bits and signaled in the bitstream in addition to the plural parameter values of the primary encoded information; and outputting a result usable for playback of the speech signal from the computing device.

2. The method of claim 1 wherein the subset is also selected based at least in part on network loss rate or decoder loss rate.

3. The method of claim 1 wherein the subset is also selected based at least in part on frame class.

4. The method of claim 1 wherein the primary encoded information is packed into a single packet with forward error correction information for a preceding frame.

5. The method of claim 1 wherein the speech processing tool is a real-time speech encoder that uses linear prediction, wherein the result is encoded speech which is decodable into reconstructed speech for the speech signal, and wherein the plural parameter values are plural linear prediction parameter values.

6. The method of claim 1 wherein the speech processing tool is a real-time speech decoder that uses linear prediction, wherein the result is reconstructed speech, and wherein the plural parameter values are plural linear prediction parameter values.

7. In a speech processing tool operated on a computing device, a method comprising:

receiving a frame for a speech signal at the computing device, the frame representing audio samples taken from the speech signal;

processing the frame for the speech signal with the computing device, the processing the frame including processing primary encoded information for the frame and plural versions of forward error correction information for the frame, wherein each of the plural versions of forward error correction information for the frame is separately signaled in a bitstream in addition to the primary encoded information for the frame, wherein the primary encoded information comprises plural parameter values, and wherein each of the plural versions of forward error correction information comprises a different subset of the plural parameter values for the frame; and outputting a result usable for playback of the speech signal from the computing device.

8. The method of claim 7 wherein each of the plural versions of forward error correction information is packed into a different packet for network transmission.

9. The method of claim 7 wherein the speech processing tool is a real-time speech encoder that uses linear prediction, wherein the result is encoded speech which is decodable into reconstructed speech for the speech signal, and wherein the plural parameter values are plural linear prediction parameter values.

10. The method of claim 7 wherein the speech processing tool is a real-time speech decoder that uses linear prediction, wherein the result is reconstructed speech, and wherein the plural parameter values are plural linear prediction parameter values.

11. In an audio processing tool operated on a computing device, a method comprising:

receiving encoded information for an audio signal at the computing device;

processing encoded information for the audio signal with the computing device, the encoded information representing audio samples taken from the speech signal, wherein the encoded information includes forward error correction information for a first frame and primary encoded information for a second frame, wherein the forward error correction information for the first frame and the primary encoded information for the second frame are signaled in a bitstream in addition to forward error correction information for the second frame and primary encoded information for the first frame, and wherein at least some of the forward error correction information for the first frame is predictively encoded relative to the primary encoded information for the second frame; and outputting a result usable for playback of the speech signal from the computing device.

12. The method of claim 11 wherein a single packet includes the forward error correction information for the first frame and the primary encoded information for the second frame.

13. The method of claim 12 wherein the single packet further includes forward error correction information for one or more other frames.

14. The method of claim 11 wherein the second frame is the current frame and the first frame is a preceding frame.

15. The method of claim 11 wherein the forward error correction information for the first frame comprises linear prediction coefficient information predicted from corresponding coefficient information for the second frame.

16. The method of claim 15 wherein the forward error correction information for the first frame comprises one or more excitation parameters predicted from corresponding excitation parameters for the second frame.

17. The method of claim 11 wherein the audio processing tool is a real-time speech encoder and the result is encoded speech which is decodable into reconstructed speech for the speech signal.

18. The method of claim 11 wherein the audio processing tool is a real-time speech decoder and the result is reconstructed speech.

* * * * *

UNITED STATES PATENT AND TRADEMARK OFFICE

CERTIFICATE OF CORRECTION

PATENT NO. : 7,668,712 B2
APPLICATION NO. : 10/816466
DATED : February 23, 2010
INVENTOR(S) : Wang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1523 days.

Signed and Sealed this

Seventh Day of December, 2010

David J. Kappos

David J. Kappos
*Director of the United States Patent and Trademark Office*